US010240890B2

(12) United States Patent
Trpkovski

(10) Patent No.: US 10,240,890 B2
(45) Date of Patent: Mar. 26, 2019

(54) STOCK FOR CROSSBOW OR GUN

(71) Applicant: P.T. Archery LLC, Prairie Du Sac, WI (US)

(72) Inventor: Paul Trpkovski, Kailua Kona, HI (US)

(73) Assignee: P.T. Archery LLC, Prairie Du Sac, WI (US)

( * ) Notice: Subject to any disclaimer, the term of this patent is extended or adjusted under 35 U.S.C. 154(b) by 0 days.

(21) Appl. No.: 15/845,603

(22) Filed: Dec. 18, 2017

(65) Prior Publication Data

US 2018/0172394 A1 Jun. 21, 2018

Related U.S. Application Data

(60) Provisional application No. 62/437,529, filed on Dec. 21, 2016.

(51) Int. Cl.

| | |
|---|---|
| ***F41B 5/12*** | (2006.01) |
| ***F41C 23/00*** | (2006.01) |
| ***F41B 5/14*** | (2006.01) |

(52) U.S. Cl.

CPC ..... *F41C 23/00* (2013.01); *F41B 5/12* (2013.01); *F41B 5/143* (2013.01); *F41B 5/1426* (2013.01); *F41B 5/123* (2013.01)

(58) Field of Classification Search

CPC ..... F41B 5/12; F41B 5/123

See application file for complete search history.

(56) References Cited

U.S. PATENT DOCUMENTS

| | | | | |
|---|---|---|---|---|
| 4,002,236 | A | 1/1977 | Tolleson et al. | |
| 4,942,861 | A | 7/1990 | Bozek et al. | |
| 5,209,215 | A | 5/1993 | Morrison et al. | |
| 5,522,373 | A | 6/1996 | Barnett et al. | |
| 5,749,348 | A | 5/1998 | Oviedo-Reyes et al. | |
| 8,622,050 | B2 | 1/2014 | Goff et al. | |
| 9,140,513 | B2 | 9/2015 | Trpkovski | |
| 9,568,269 | B1 | 2/2017 | Chang et al. | |
| 10,139,190 | B1 | 11/2018 | Trpkovski | |
| 2016/0169612 | A1* | 6/2016 | Kim | F41B 5/0094 124/25 |
| 2016/0252320 | A1* | 9/2016 | Kinmont, Jr. | F41B 5/12 124/25 |
| 2018/0340751 | A1 | 11/2018 | Trpkovski | |

OTHER PUBLICATIONS

"Non-Final Office Action," for U.S. Appl. No. 15/863,007 dated Mar. 8, 2018 (9 pages).

"Response to Non Final Office Action," for U.S. Appl. No. 15/863,007, filed Apr. 12, 2018 (9 pages).

"Draw-Loc Product Webpage," http://www.drawloc.com/drawloc, retrieved Jan. 15, 2017 (5 pages).

* cited by examiner

*Primary Examiner* — John Ricci

(74) *Attorney, Agent, or Firm* — Pauly, DeVries Smith & Deffner LLC

(57) ABSTRACT

Embodiments include a stock for a crossbow or gun that includes two stock plates coupled to each other. The two stock plates define a gap. In an embodiment, the two stock plates are coupled to each other with one or more dampening elements. In an embodiment, the two stock plates diverge from each other towards one end of the stock, such that the gap widens towards the front end of the stock. In an embodiment, the stock is configured to shoot an arrow with the cock feather oriented vertically upwards or away from the stock. Other embodiments are also included herein.

17 Claims, 29 Drawing Sheets

STOCK FOR CROSSBOW OR GUN

CLAIM OF PRIORITY

This application claims the benefit of U.S. Provisional Application No. 62/437,529, filed Dec. 21, 2016, the content of which is herein incorporate by reference in its entirety.

FIELD

Embodiments herein relate to a stock for a crossbow or gun, such as a rifle, airgun, BB gun or other structure with a long barrel or stock.

BACKGROUND

Crossbows and firearms have been in use for hundreds of years. People frequently travel over long distances while carrying a crossbow or firearm, such as while hunting. Therefore, there is a need to decrease weight of a crossbow or firearm making it easier to travel without decreasing the power or structural integrity of the crossbow or firearm.

SUMMARY

Various embodiment disclosed herein provide a crossbow that includes a stock and a bow portion. The stock includes a first stock plate and a second stock plate. The first stock plate and the second stock plate define a gap. The bow portion includes a riser assembly, a first limb coupled to the riser assembly, a second limb coupled to the riser assembly; and a drawstring extending from a distal end of the first limb to a distal end of the second limb. The bow portion is coupled to the stock. A width of the gap is at least ½ inch and not more than 2 inches. The first stock plate and the second stock plate are each no more than ¼ inch thick.

In various embodiments, the first stock plate and the second stock plate are parallel along at least 50% of a length of the stock.

In various embodiments, the first stock plate and the second stock plate are planar along the at least 50% of the length of the stock where the first stock plate and the second stock plate are parallel.

In various embodiments, the first stock plate and the second stock plate diverge from each other along a portion of the length of the stock to increase the size of the gap.

In various embodiments, wherein the stock comprises an arrow channel element, wherein the arrow channel element defines an arrow channel; wherein the arrow channel element is configured to receive an arrow with a cock feather orientated vertically away from a bottom portion of the stock, wherein a handle portion extends from the bottom portion of the stock.

In various embodiments, the arrow channel element comprises a first surface configured to support a first hen feather of the arrow and a second surface configured to support a second hen feather of the arrow.

In various embodiments, the cross bow further includes a dampening element disposed within the gap or within an opening defined by the first stock plate or the second stock plate In various embodiments, the gap extends through the ends of the stock, such that the first stock plate and the second stock plate are separated at the ends.

An embodiment provides a stock. The stock can include a first stock plate and a second stock plate, wherein the first stock plate and the second stock plate define a gap. The first stock plate and the second stock plate are each no more than ¼ inch thick. The stock is configured to be coupled to a gun barrel or a bow.

In various embodiments, the stock can further include a bow portion coupled to the stock.

In various embodiments, the first stock plate and the second stock plate are planar along at least 50% of the length of the stock.

In various embodiments, the first stock plate and the second stock plate each comprise carbon fiber, aluminum, titanium, a polymer, or wood.

In various embodiments, a width of the gap is at least ½ inch and not more than 2 inches along at least 50% of the length of the stock.

In various embodiments, the first stock plate and the second stock plate are each a single continuous component.

In various embodiments, the gap extends through the ends of the stock, such that the first stock plate and the second stock plate are separated at the ends.

In various embodiments, the stock can further include a dampening element disposed within the gap or within an opening defined by the first stock plate or the second stock plate.

An embodiment provides a stock for a crossbow or rifle. The stock can include a first stock plate and a second stock plate, wherein the first stock plate and the second stock plate define a gap, and a bow or rifle mounting element coupled to or defined by the first stock plate or the second stock plate.

In various embodiments, a width of the gap is at least ½ inch and not more than 2 inches along at least 50% of the length of the stock.

In various embodiments, a width of the gap varies along the length of the stock.

In various embodiments, the width of the gap is the largest at an end of the stock.

BRIEF DESCRIPTION OF THE FIGURES

Aspects may be more completely understood in connection with the following figures, in which:

FIG. 6 is a back view of a portion of a crossbow, according to an embodiment.

While embodiments are susceptible to various modifications and alternative forms, specifics thereof have been shown by way of example and drawings, and will be described in detail. It should be understood, however, that the scope herein is not limited to the particular embodiments described. On the contrary, the intention is to cover modifications, equivalents, and alternatives falling within the spirit and scope herein.

DETAILED DESCRIPTION

The embodiments described herein are not intended to be exhaustive or to limit the invention to the precise forms disclosed in the following detailed description. Rather, the embodiments are chosen and described so that others skilled in the art can appreciate and understand the principles and practices.

All publications and patents mentioned herein are hereby incorporated by reference. The publications and patents disclosed herein are provided solely for their disclosure. Nothing herein is to be construed as an admission that the inventors are not entitled to antedate any publication and/or patent, including any publication and/or patent cited herein.

Described herein are various embodiments of a stock that can be used for a crossbow or rifle. The embodiments of a stock described herein can be lighter weight compared to traditional stock, such that they are easier to transport especially over long distances. The various embodiments described herein can also include superior structural integrity such that the stock can withstand forces that are equal or greater than the stocks currently being produced.

Figure 1A:
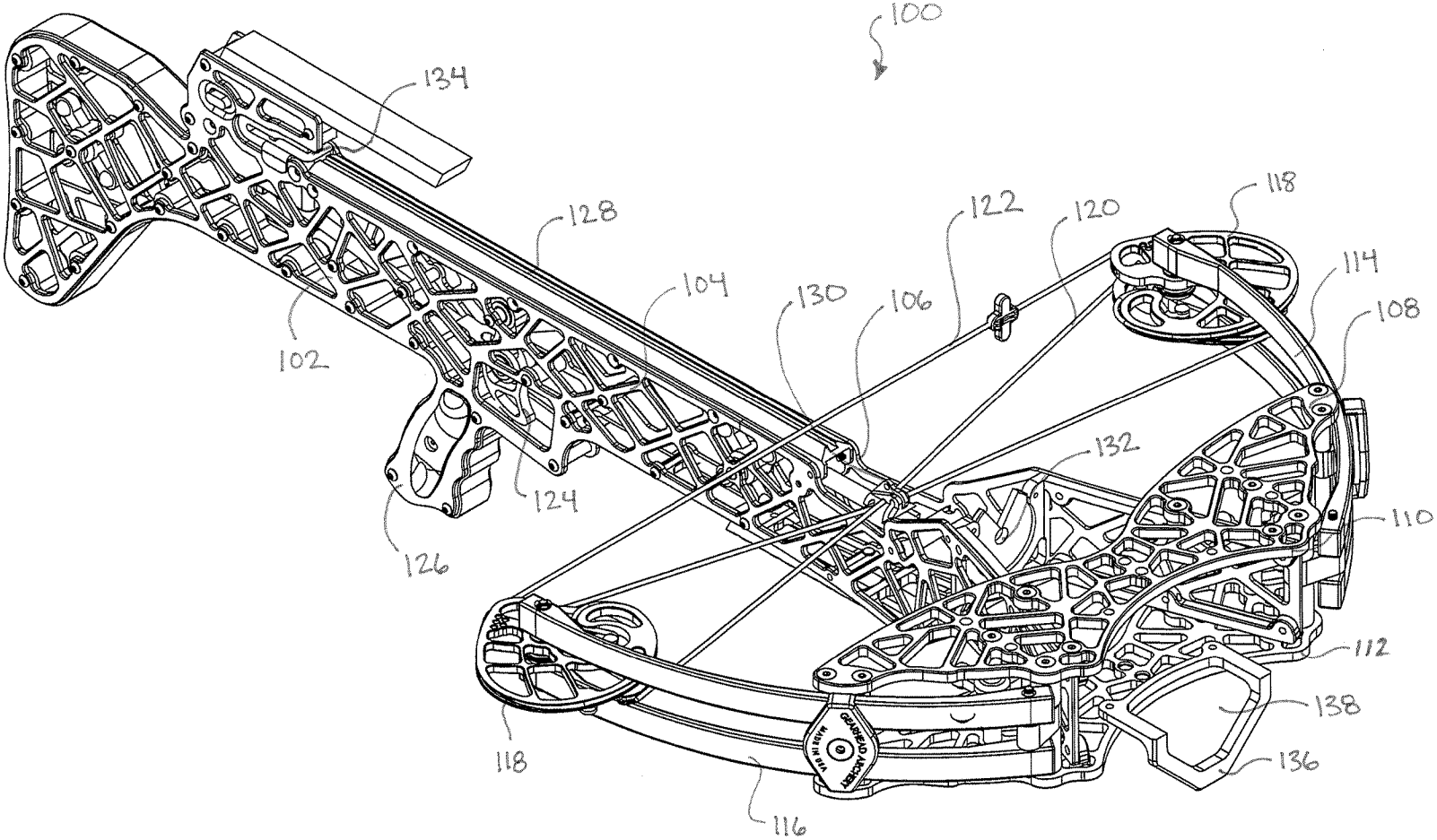
FIG. 1A is a perspective view of a crossbow, according to an embodiment.
Figure 2:
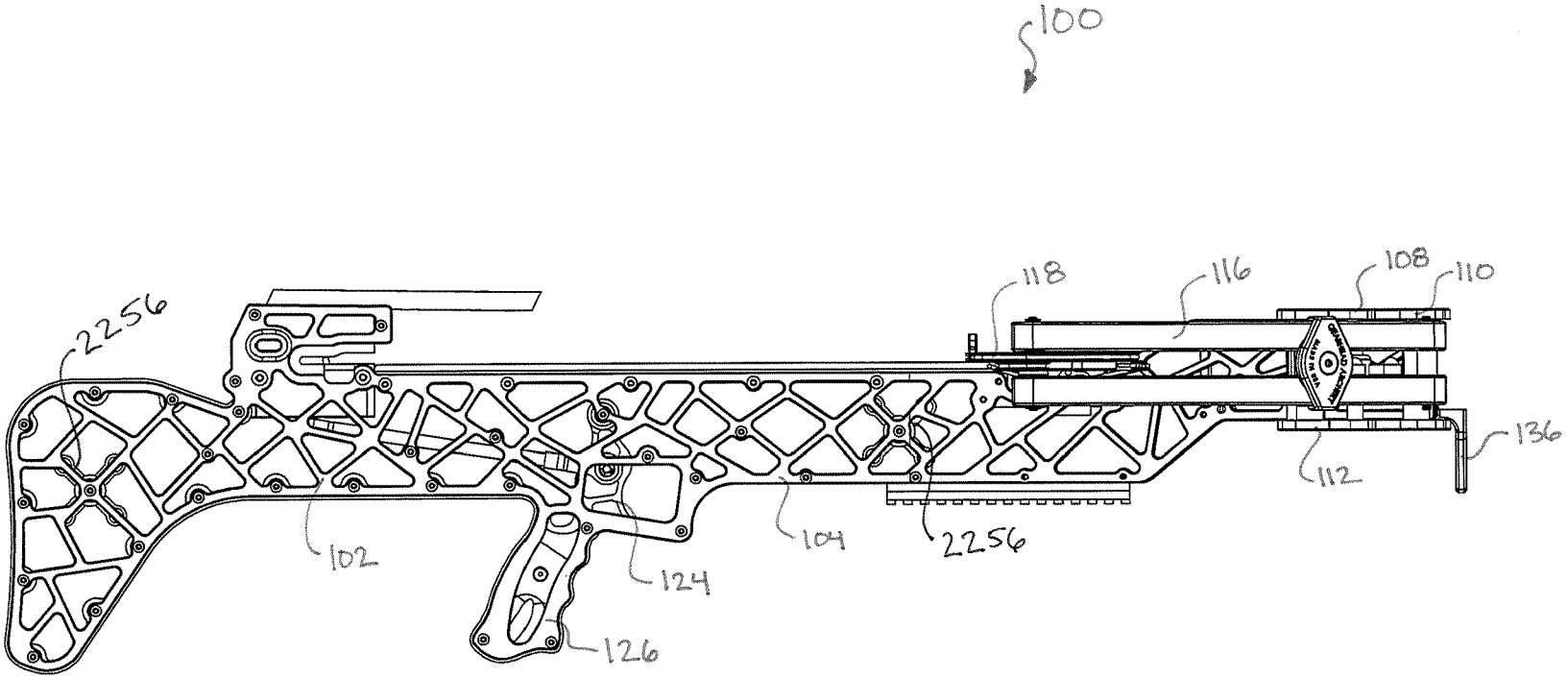
FIG. 2 is a side view of a crossbow, according to an embodiment.
Figure 3:
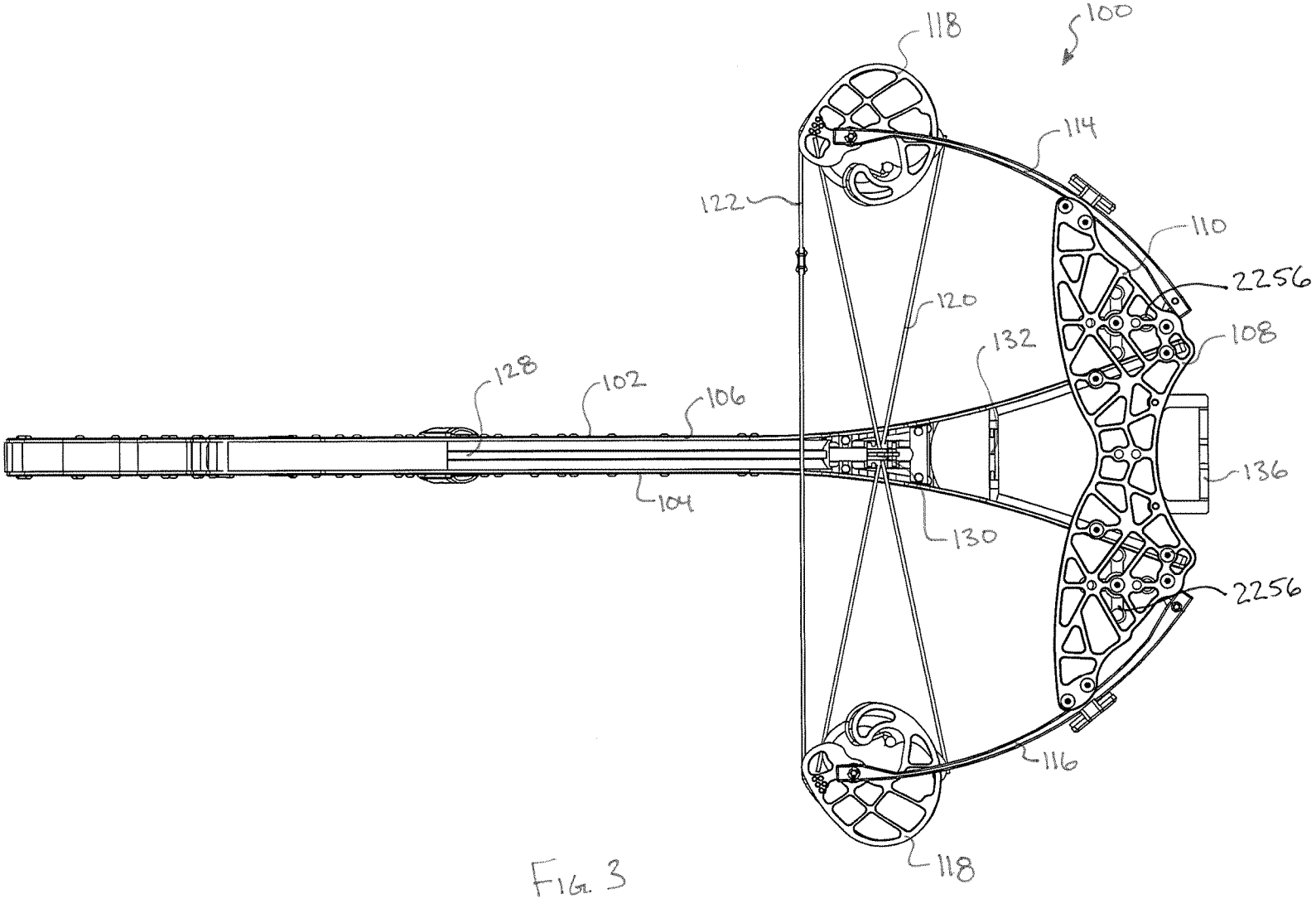
FIG. 3 is a top view of a crossbow, according to an embodiment.
Figure 4:
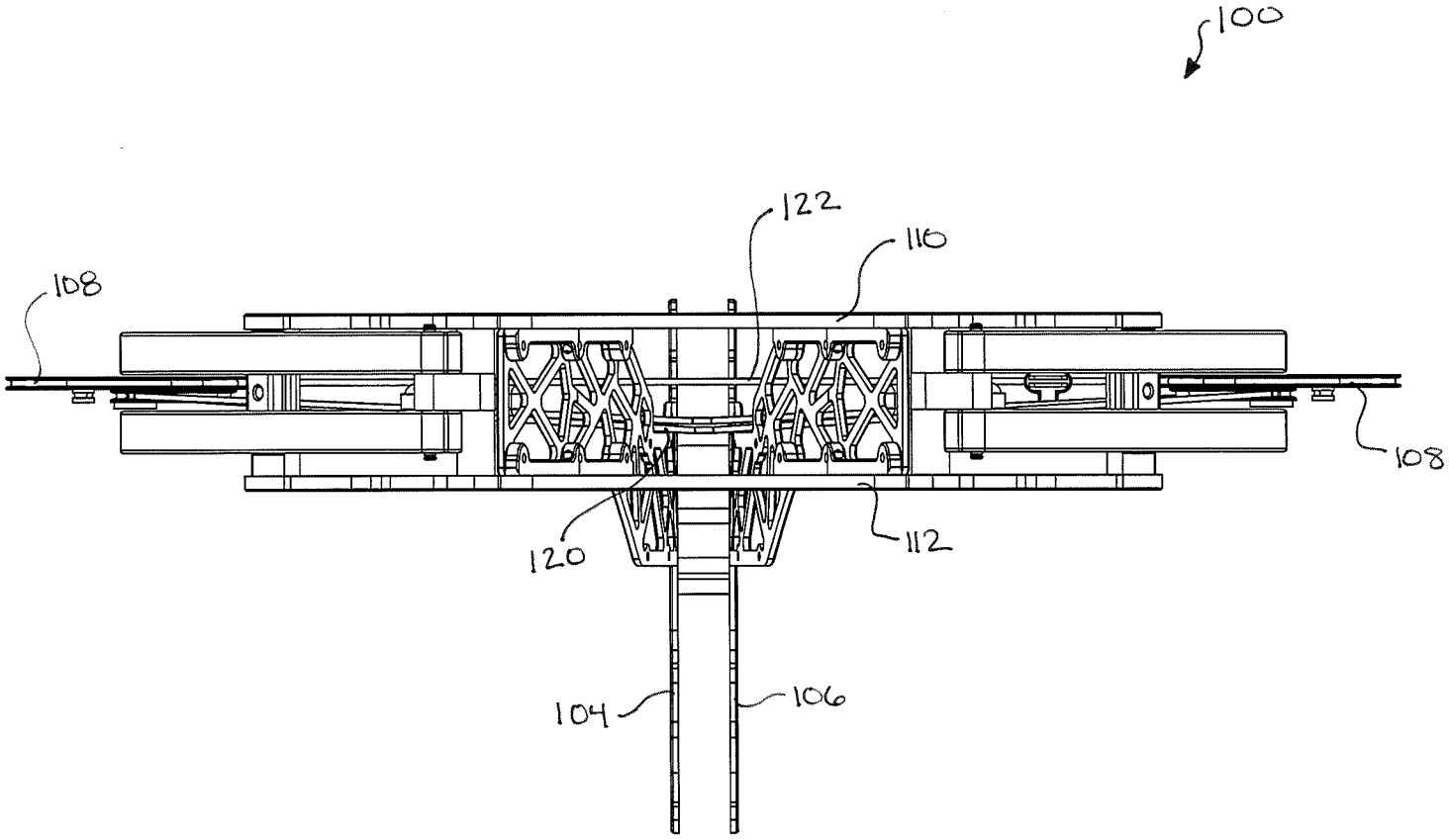
FIG. 4 is a front view of a crossbow, according to an embodiment.

FIG. 1A shows a perspective view of a crossbow 100, according to an embodiment. FIG. 2 shows a side view of the crossbow 100. FIG. 3 shows a top view of the crossbow 100. FIG. 4 shows a front view of the crossbow 100.

As shown in FIG. 1A, the crossbow 100 can include a stock 102. The stock 102 can include a first stock plate 104 and a second stock plate 106. The stock 102 can provide a base or structure for other components of the crossbow 100 to be coupled to. In an embodiment, the stock 102 can be coupled to a bow, such as the bow described in U.S. Pat. No. 9,140,513, which is herein incorporated by reference in its entirety. In other embodiments, the stock 102 can be coupled to a recurve bow or a gun barrel. The stock 102 can define an arrow channel 128. The arrow channel 128 can direct an arrow while it is traveling along the stock 102, such as immediately after it is shot or as it is being propelled forward by a drawstring 122.

In various embodiments, the stock 102 can include a bow mounting element. The bow mounting element can include one or more holes defined by the stock 102 which can facilitate the coupling of a bow portion to the stock, such as by allowing a connector or bolt to pass through a portion of the stock. In other embodiments, the bow mounting portion can include a bracket or a surface to facilitate the coupling a bow portion to the stock 102.

The crossbow 100 can include a riser assembly 108. In various embodiments, the riser assembly 108 can include a first riser plate 110 and a second riser plate 112. The first riser plate 110 and a second riser plate 112 can be coupled to each other and define a riser gap between the two plates 110, 112. In various embodiments, an arrow or bolt shot from the crossbow 100 can travel between the riser plates 110, 112 through the riser gap.

The crossbow 100 can include a first limb 114 and a second limb 116. The first and second limbs 114, 116 can be coupled to the riser assembly 108. In various embodiments, the first and second limbs 114, 116 are coupled to opposite ends of the riser assembly 108, such as ends that are on different sides of a plane defined by the stock 102.

The crossbow 100 can include one or more cams 118. In various embodiments, each end of the limbs 114, 116 can be coupled to a cam 118. One or more power cables 120 can extend between the cams 118 or between the distal ends of the limbs 114, 116. The power cables 120 can extend from the distal end of one limb 114 to the distal end of the second limb 116 crossing over the stock 102. The crossbow 100 can also include a power cable holding element 130. The power cable holding element 130 can be configured to hold the power cables 120 in a position in which the power cables 120 will not interfere with an arrow or the fletching of an arrow being shot from the crossbow 100. The power cable holding element 130 can hold the power cables below the arrow channel 128, such as closer to the side of the stock 102 from which the handle 126 extends from. In various embodiments, the handle 126 can extend from a bottom portion of the stock 102.

The crossbow 100 can include a drawstring 122 that extends from the distal end of one limb 114 to the distal end of the second limb 116. The drawstring 122 is shown in a non-drawn position in FIGS. 1A-3. When the drawstring 122 is in a drawn position, the drawstring 122 can be held in place until the user desires to shoot the arrow or projectile by activating the trigger 124 resulting the arrow retention element 134 releasing a holding force from the arrow 540 or drawstring 122.

Figure 1B:
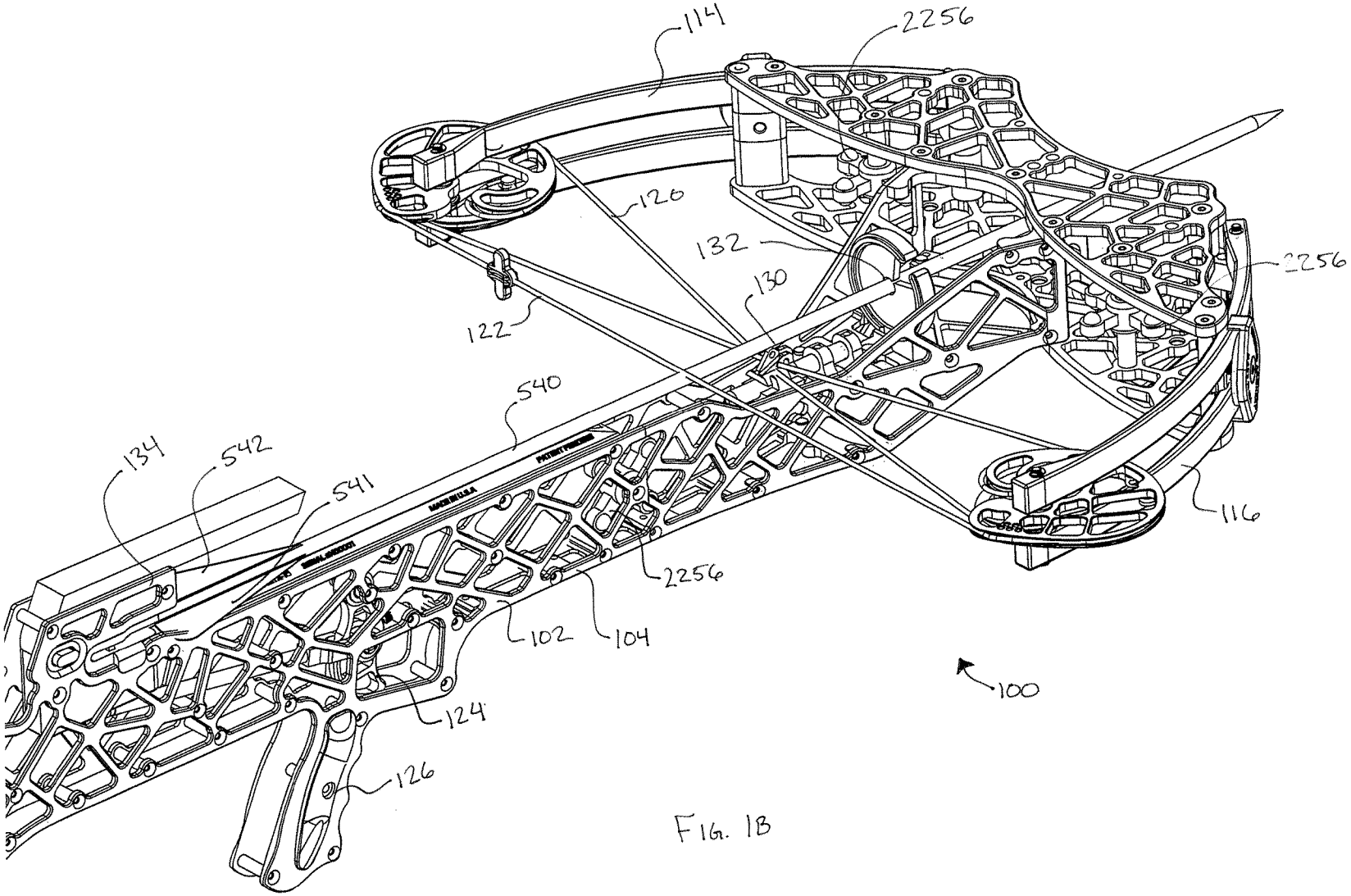
FIG. 1B is a perspective view of a crossbow, according to an embodiment.

FIG. 1B shows a perspective view of a crossbow 100 with and arrow 540. The crossbow 100 shown in FIG. 1B includes the drawstring 122 in a non-drawn position. In a drawn position, the drawstring 122 can be located within the arrow retention element 134 and within a nock of the arrow 540. The arrow retention element 134 can apply a holding force to the arrow 540 or drawstring 122 which holds the arrow 540 and drawstring 122 in place relative to the crossbow 100. Upon activating the trigger 124, the arrow retention element 134 can release the arrow 540 or drawstring 122, such that the arrow 540 is propelled forward as the drawstring 122 returns to the non-drawn position.

FIGS. 1B, 2, and 3 show dampening element 2256. As will be discussed below with regards to FIGS. 22A and 22B, the crossbow 100 can include one or more dampening elements 2256. In some embodiments, one or more dampening elements 2256 can be disposed between the first stock plate 104 and the second stock plate 106. In some embodiments, one or more dampening elements 2256 can be disposed between the first riser plate 110 and the second riser plate 112. In some embodiments, a dampening element 2256 can be disposed within an opening defined by the first stock plate 104, the second stock plate 106, the first riser plate 110, or the second riser plate 112.

FIG. 4 shows the drawstring 122 extending straight across, parallel to the riser plates 110, 112. FIG. 4 further shows the power cables 120 being held below where the power cables 120 would be without the power cable holding element 130. The power cable holding element 130 can hold the power cables 120 out of the path of the feathers of an arrow being shot from the crossbow 100.

The crossbow 100 can include a handle 126. The handle 126 can extend from the stock 102 on the opposite side of the stock 102 from the arrow channel 128. The handle 126 can be configured to be gripped or held by the user, such as while the user is aiming and/or shooting the crossbow 100.

The crossbow 100 can further include an arrow rest 132 and an arrow retention element 134. The crossbow 100 can be configured to shoot an arrow or other projectile, such as a bolt. In an embodiment, an arrow can be disposed in the arrow channel 128. The arrow and drawstring 122 can be held near the butt end of the crossbow 100 by the arrow retention element 134. The arrow retention element 134 can release the drawstring 122 and arrow when the trigger 124 is activated to shoot the arrow.

The crossbow 100 can include a foot stirrup 136. The foot stirrup 136 can define an aperture 138. A user can utilize the foot stirrup 136 when pulling the drawstring 122 into a drawn position. A user can insert his/her foot at least partially into the aperture 138, while he/she pulls the drawstring 122 into the drawn position.

Figure 5A:
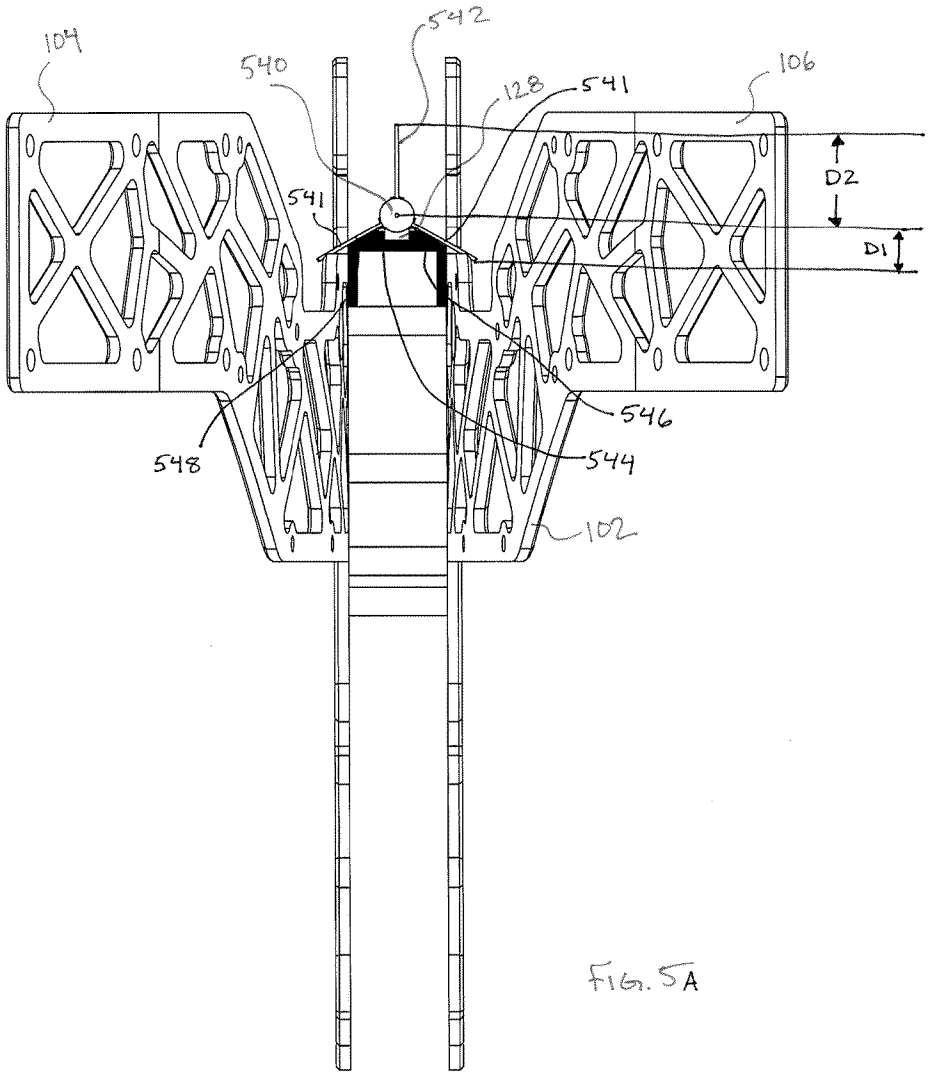
FIG. 5A is a front view of a portion of a crossbow, according to an embodiment.

FIG. 5A shows a front view of a portion of a crossbow 100 and FIG. 6 shows a back view of the portion of the crossbow 100, according to an embodiment. FIGS. 5A and 6 show a crossbow 100 without the riser assembly for clarity purposes. FIG. 5A shows the stock 102, the first stock plate 104, the second stock plate 106, the arrow channel 128, and an arrow 540. In various embodiments, the arrow 540 can include three feathers or fletching. One of the feathers can be the cock feather 542, the other two feathers can be hen feathers 541. The crossbow 100 is configured to shoot an arrow 540 with the cock feather 542 oriented in a vertically upwards position, such as shown in FIG. 5A.

With the cock feather 542 in a vertically upwards position away from the stock 102 or handle 126, the amount of space below the arrow 540 that is required for clearance can be reduced compared to if the cock feather were pointed down. The clearance can ensure that the hen feathers 541 do not contact or hit any portions of the crossbow 100, which could affect the arrows 540 direction of travel and/or speed of travel.

Typically, if the power cables were not held away from the center of the riser, the power cables 120 would contact the feathers of the arrow 540 when the arrow 540 is shot. Therefore, the power cables 120 are held in a position away from the center of the riser assembly, so that there is a clearance between the power cables 120 and the feathers 541, 542. Configuring the crossbow 100 to shoot an arrow 540 with the cock feather 542 vertically upwards, reduces the distance the power cables 120 need to be moved relative to the power cables 120 at rest position, since the two hen feathers 541 do not extend downwards or towards the stock as far when the cock feather 542 is upwards compared to the cock feather 542 being oriented downwards and to the sides. Decreasing the distance the power cables 120 are held away from non-moved, rest position can decrease the amount of wear and tear on the power cables 120, thereby extending the lifespan of the power cables 120. As can be seen in FIG. 5A, the vertical distance D1 is less than the vertical distance D2. The vertical distance D1 represents the amount of space needed for the hen feathers 541 to clear the power cables 120 when the cock feather 542 is upwards. The vertical distance D2 represents the amount of space needed for the cock feather 542 to clear the power cables 120 when the cock feather 542 is downwards.

Figure 30:
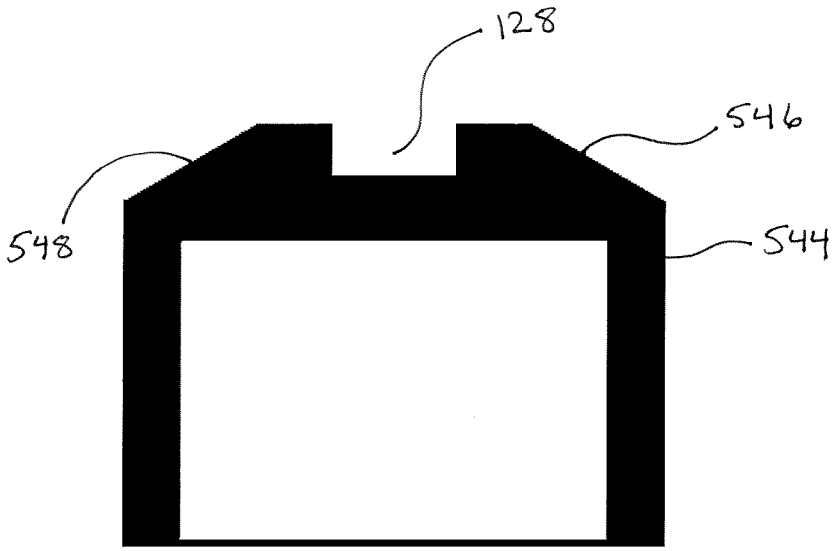
FIG. 30 is a front view of the arrow channel, according to an embodiment.

The crossbow 100 can include an arrow channel element 544, shown in FIG. 30. The arrow channel element 544 can define the arrow channel 128. The arrow channel 128 can be configured for the shaft of the arrow 540 to travel partially within as the arrow 540 is shot from the crossbow 100. The arrow 540 can also be at least partially within the arrow channel 128 when the crossbow is loaded with an arrow 540 and being prepared to be shot.

Figure 5B:
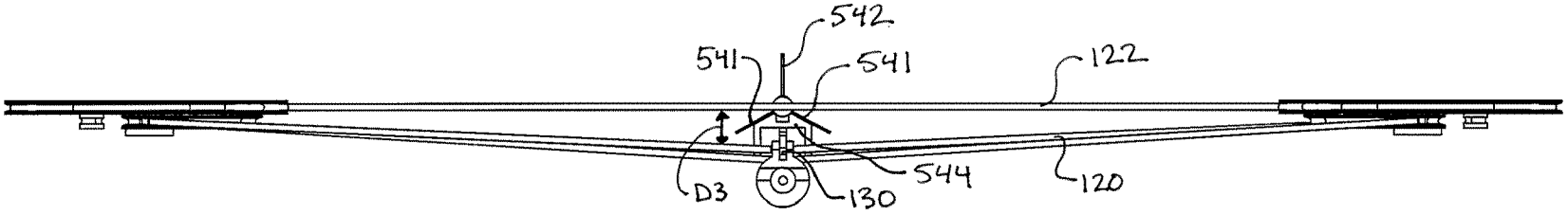
FIG. 5B is a back view of a portion of a crossbow, according to an embodiment.
Figure 5C:
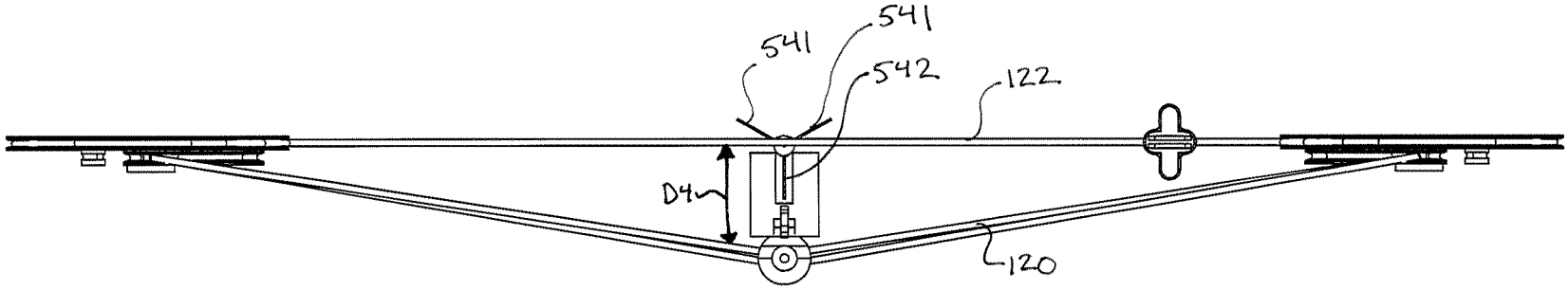
FIG. 5C is a back view of a portion of a crossbow, according to an embodiment.
Figure 5D:
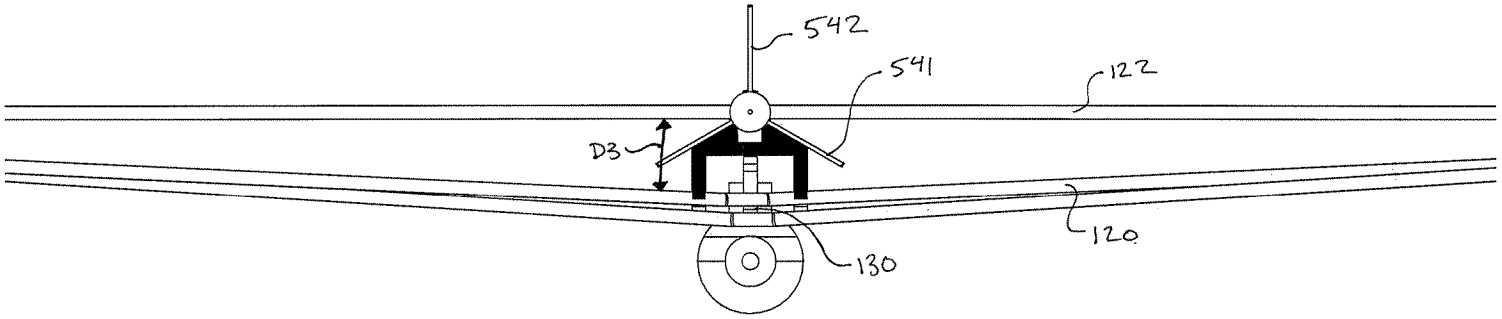
FIG. 5D is a back view of a portion of a crossbow, according to an embodiment.

FIGS. 5B and 5D show a back view of a crossbow 100, according to an embodiment. As shown in FIGS. 5B and 5D, the crossbow 100 can be configured to shoot an arrow with the cock feather 542 arranged in a vertically upwards position.

In contrast to FIGS. 5B and 5D, FIGS. 5C and 5E show a back view of a crossbow configured to shoot an arrow with the cock feather 542 arranged in a vertically downwards position. With the cock feather 542 in a vertically downwards manner, the arrow can be guided with the cock feather 542 traveling along and within a cock feather recess 558. The cock feather 542 can be disposed within the recess 558. The recess 558 can guide the arrow as it is shot from the crossbow.

As discussed above in regards to FIG. 5A, positioning the cock feather 542 vertically upwards can reduce the amount of distance that the power cables need to be moved in order to provide the necessary clearance from the arrow. The reduction in distance can reduce wear and tear on the power cables.

Figure 5E:
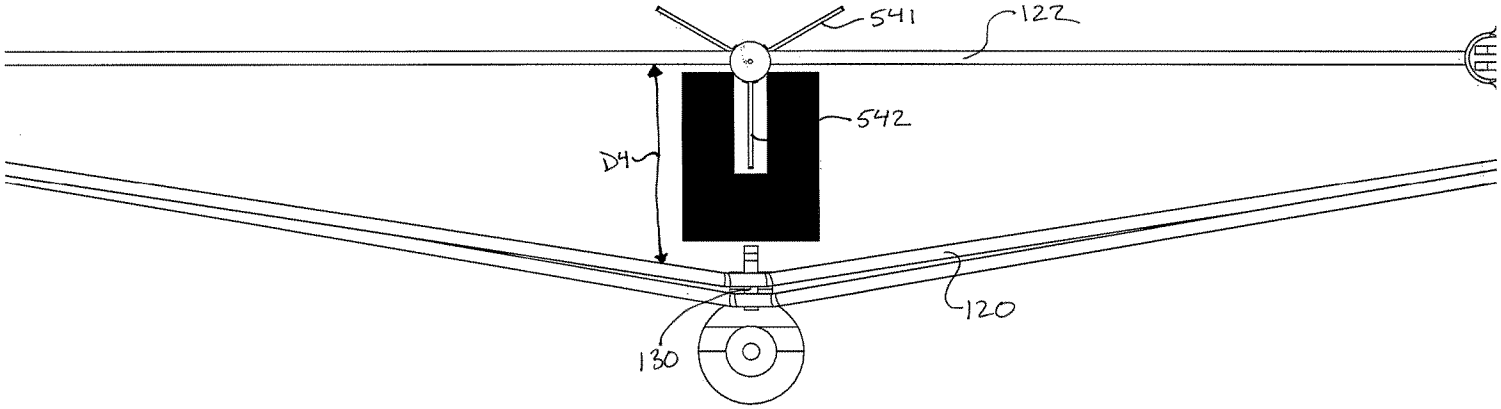
FIG. 5E is a back view of a portion of a crossbow, according to an embodiment.

As shown in comparing FIGS. 5B and 5D with FIGS. 5C and 5E, distance D3 in FIGS. 5B and 5D is smaller than distance D4 in FIGS. 5C and 5E. Distance D3 relates to the distance from the drawstring to where the power cables are held. The power cables are held in a position which provides sufficient clearance from the hen feathers 541. Distance D4 relates to the distance from the drawstring to where the power cables are held. The power cables are held in a position which provides sufficient clearance from the cock feather 542. Since distance D1 (In FIG. 5A) is smaller than distance D2 (in FIG. 5A), distance D3 can be smaller than distance D4.

The arrow channel element 544 can include two sloped surfaces 546, 548. The two sloped surfaces can form an angle of about 120 degrees, such that the two hen feathers 541 can travel along the sloped surfaces as the arrow 540 is shot from the crossbow 100.

Figure 9:
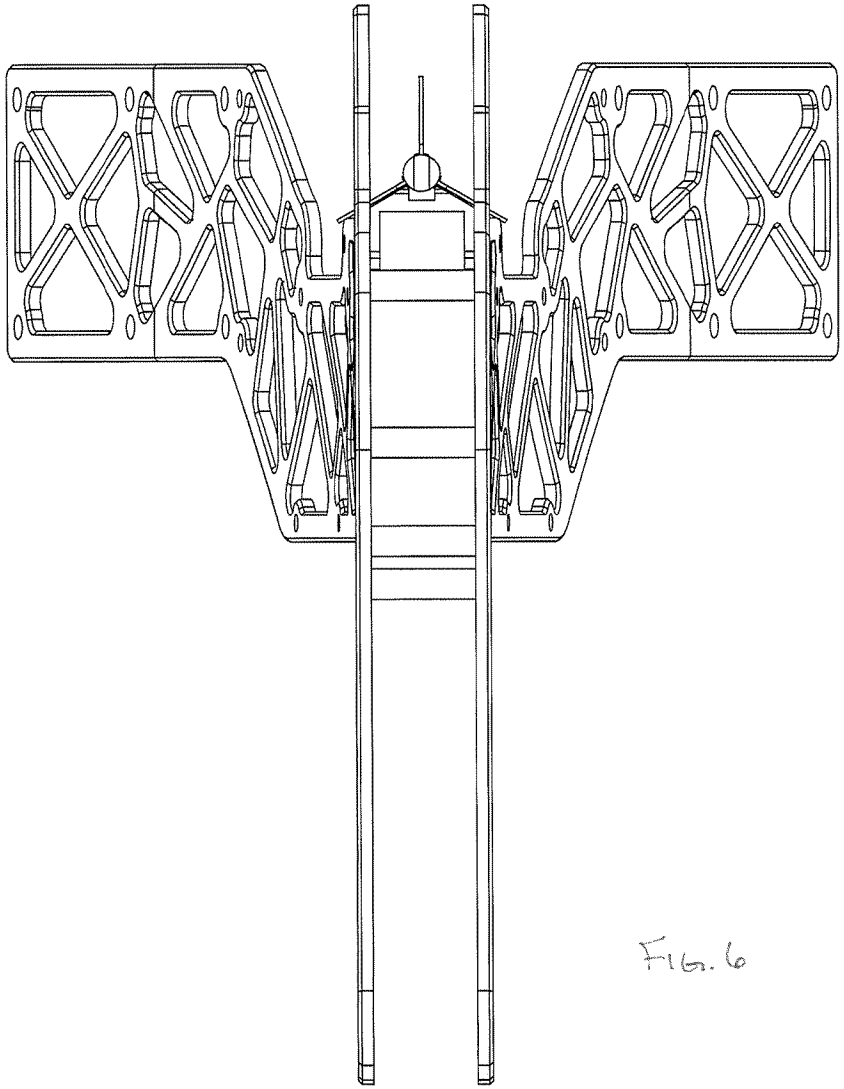
FIG. 9 is a top view of a stock for a crossbow, according to an embodiment.
Figure 7:
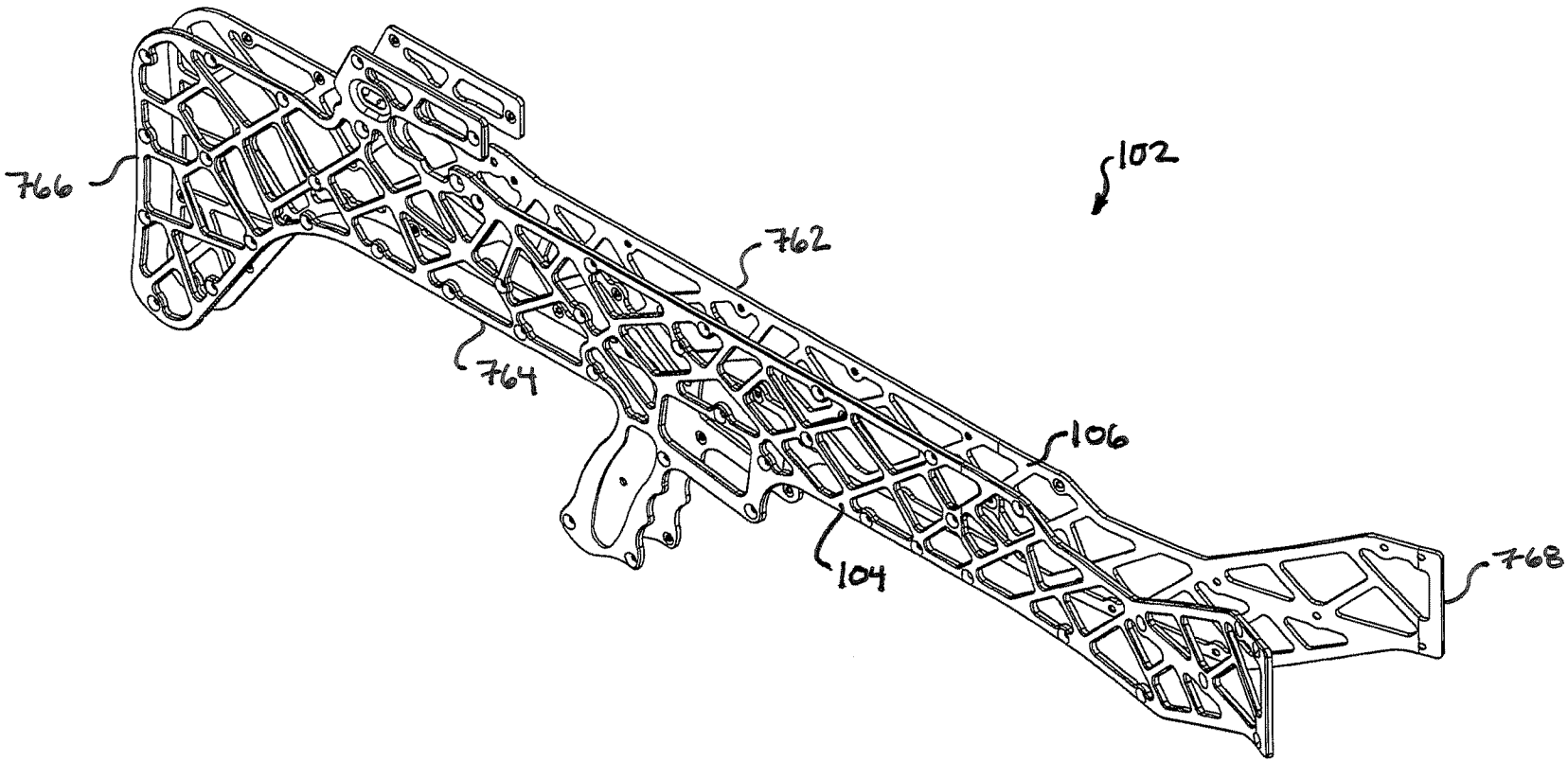
FIG. 7 is a perspective view of a stock for a crossbow, according to an embodiment.
Figure 8:
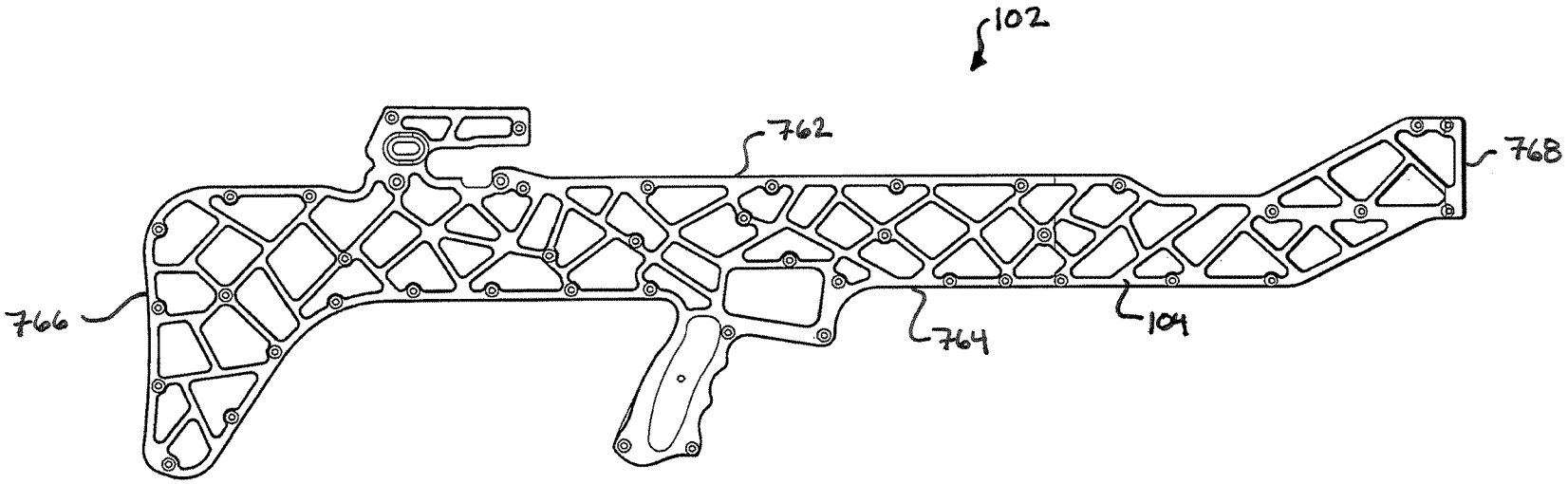
FIG. 8 is a side view of a stock for a crossbow, according to an embodiment.
Figure 9:
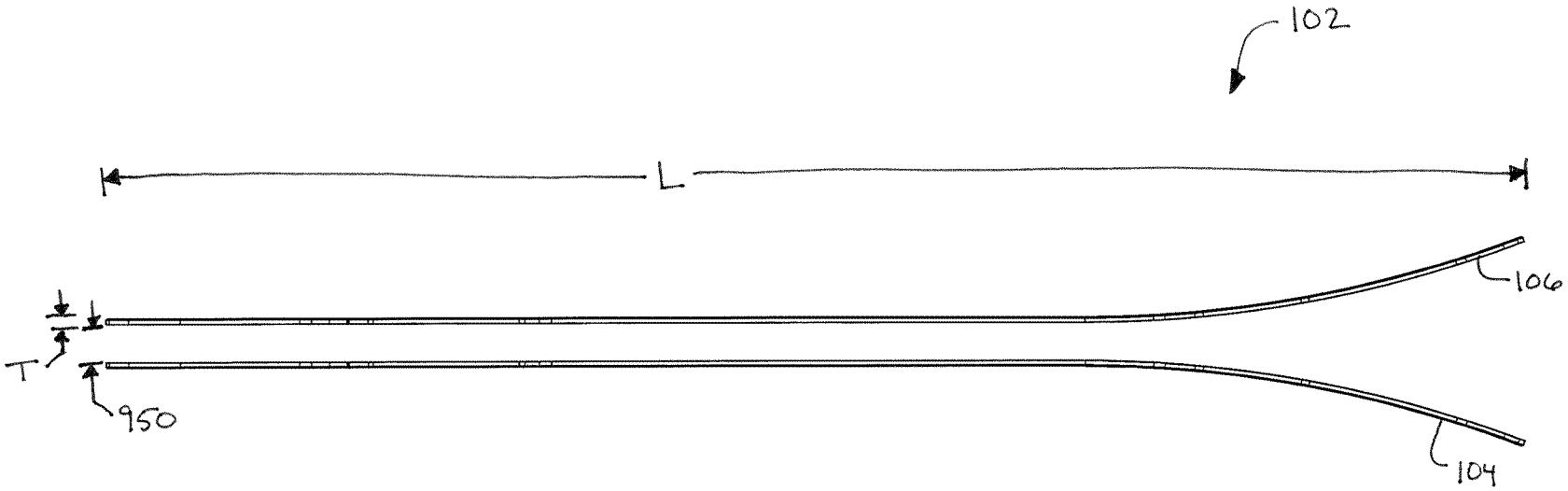

FIGS. 7-9 show various views of a stock 102 for a crossbow 100, according to an embodiment. The stock 102 can include a first stock plate 104 and a second stock plate 106. The stock 102 can be symmetric, such as having a line of symmetry extending along the length of the stock 102. In various embodiments, the first stock plate 104 can be a mirrored version of the second stock plate 106. In some embodiments, each of the two stock plates 104, 106 can be one piece, monolithic, or a single continuous plate. In one embodiment, the stock plate 104, 106 is machined or stamped from a single piece of material. In one embodiment, the stock plate is cast or molded as a single piece of material.

The stock 102 can include a top portion 762. The stock can include a bottom portion 764 opposite from the top portion 762. The top portion 762 and bottom portion can extend along the length of the stock 102. The stock 102 can include a first end 766 and a second end 768. The first end 766 can be located on the opposite side of the stock 102 from the second end 768. In various embodiments, the gap 950 can extend along a longitudinal axis of the stock 102 through one or both of the ends 766, 768. In some embodiments, the gap 950 can extend along a vertical axis of the stock 102 and through the top portion 762 and the bottom portion 764.

In various embodiments, at least portions of the first and second stock plates 104, 106 can be planar or flat, such that an inside surface of the stock plate that defines a portion of the gap is parallel with an outside surface of the stock plate. In an embodiment, the first stock plate 104 and the second stock plate 106 are planar along the at least 50% of the length of the stock 102, such as a portion of the stock 102 where the stock plates 104, 106 are parallel with each other.

The first and second stock plates 104, 106 can include carbon fiber, aluminum, titanium, a polymer, or wood. In various embodiments, the two stock plates 104, 106 together can have a weight of less than 5 lbs. In various embodiments, the two stock plates 104, 106 together can have a weight of less than 4 lbs. In some embodiments, the first and second stock plates 104, 106 can have a thickness ("T") of 0.5 inches or less. In some embodiments, the first and second stock plates 104, 106 can have a thickness of 0.25 inches or less. In some embodiments, the first and second stock plates 104, 106 can have a thickness of 0.125 inches or less or a thickness of 0.125 inches. In some embodiments, the first and second stock plates 104, 106 can have a thickness of at least 0.039 inches (about 1 mm) or greater. In some embodiments, the thickness of the stock plates 104, 106 can be consistent, such that the thickness only varies within manufacturing tolerances.

In various embodiments, the stock plates 104, 106 define openings. In an embodiment, at least 25% of the surface area of the stock plates 104, 106 is open. For example, the openings cover at least 25% of the surface area of the stock plate 104, 106. In an embodiment, at least 30% of the surface area of the stock plates 104, 106 is open. In an embodiment, at least 50% of the surface area of the stock plates 104, 106 is open. As a result of the openings, the stock plates are lighter weight compared to if the stock plates had a solid structure. In an embodiment, the crossbow 100 can weigh less than 6 lbs. In an embodiment, the crossbow 100 can weigh less than 5 lbs. In an embodiments, the crossbow 100 can weigh less than 4.5 lbs. In an embodiment, the crossbow 100 can weigh about 4.2 lbs.

In various embodiments, the first stock plate 104 and the second stock plate 106 can define a gap 950. In various embodiments, the first stock plate 104 and the second stock plate 106 can be parallel along at least 50% of the length ("L") of the stock 102. In various embodiments, the first stock plate 104 and the second stock plate 106 can be parallel along at least 75% of the length ("L") of the stock 102.

In various embodiments, the stock plates 104, 106 can diverge from each other, such that the gap 950 is increased in size. In an embodiment, the gap 950 can increase at least two times in size one end of the stock 102 to the other end. The narrower portion of the gap 950 is where the stock plates 104, 106 are parallel to each other. The wider portion of the gap 950 is where the stock plates 104, 106 are coupled to the riser assembly 108, such as at the most rearward bolts connecting the riser assembly 108 to the stock 102. For example, the gap 950 where the stock plates 104, 106 are parallel can be about 1 inch and the stock plates 104, 106 can diverge such that they are spaced apart by about 2 inches. In an embodiment, the gap 950 can increase at least four times in size from one end to the other. In other words, the gap 950 can increase at least four times in size from a portion of the stock 102 where the stock plates 104, 106 are parallel to an opposite end of the stock plates 104, 106, or to where the stock plates 104, 106 are coupled to the riser assembly 108. For example, the gap 950 where the stock plates 104, 106 are parallel can be about 1 inch and the stock plates 104, 106 can diverge such that they are spaced apart by about 4 inches.

In various embodiments, the gap 950 along a portion of the stock 102 where the stock plates 104, 106 are parallel can be 0.5 inches or larger. In various embodiments, the gap 950 along a portion of the stock 102 where the stock plates 104, 106 are parallel can be 1 inch or larger. In various embodiments, the gap 950 along a portion of the stock 102 where the stock plates 104, 106 are parallel can be 1.5 inches or larger. In various embodiments, the gap 950 along a portion of the stock 102 where the stock plates 104, 106 are parallel can be 2 inches or less. In various embodiments, the gap 950 along a portion of the stock 102 where the stock plates 104, 106 are parallel can be 2.5 inches or less. In various embodiments, the gap 950 along a portion of the stock 102 where the stock plates 104, 106 are parallel can be 3 inches or less. In various embodiments, the gap 950 along a portion of the stock 102 where the stock plates 104, 106 are parallel can be about 1 inch.

Figure 10:
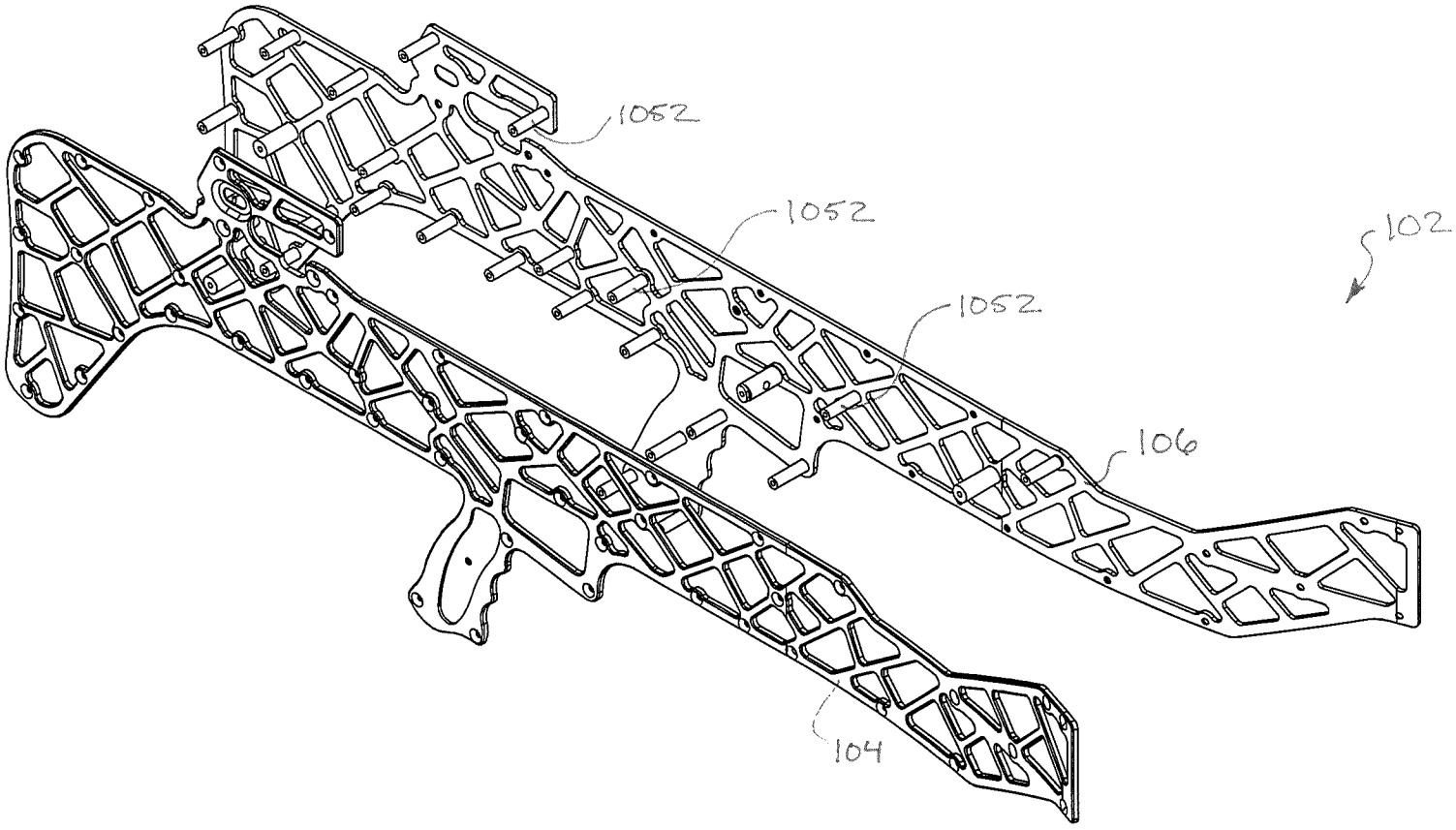
FIG. 10 is an exploded view of a stock for a crossbow, according to an embodiment.

FIG. 10 shows an exploded view of a stock 102 for a crossbow, according to an embodiment. The stock 102 can include a first stock plate 104 and a second stock plate 106. The first stock plate 104 can be coupled to the second stock plate 106 with a plurality of connectors 1052. In various embodiments, the connectors 1052 can have a circular cross-section, an oval cross-section or a rectangular cross-section.

In some embodiments, the connectors 1052 can have a length equal to the size of the gap 950. In some embodiments, the connectors 1052 can extend partially into one or both of the stock plates 104, 106, such that the gap 950 is smaller than the length of a connector 1052 and to provide a mechanical connection fit between the connectors 1052 and the inside surfaces of the plates. The connectors 1052 can be positioned between the stock plates 104, 106. A fastener, such as a screw or bolt, can extend through one of the stock plates 104, 106 and into a connector. A second fastener can extend through the other stock plate 104, 106 and into the connector, such as to couple the first stock plate 104 to the second stock plate 106. The fasteners can be countersunk into the stock plates 104, 106, such as to provide a smooth or continuous outside surface of the stock 102.

Figure 11:
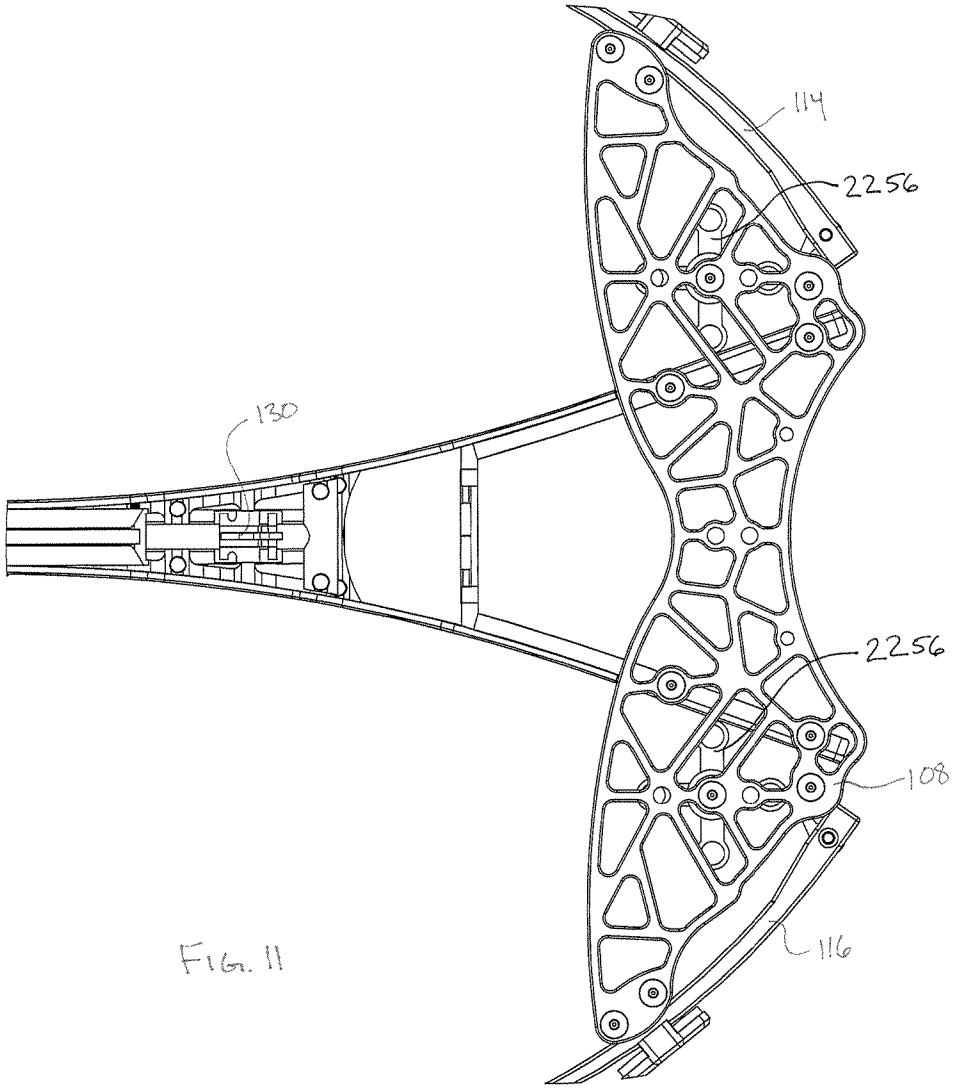
FIG. 11 is a top view of a portion of a crossbow, according to an embodiment.

FIG. 11 is a top view of a portion of a crossbow 100, according to an embodiment. FIG. 11 shows the riser assembly 108 and a portion of the first limb 114 and the second limb 116. FIG. 11 further shows the power cable holding element 130. The power cable holding element 130 can be configured to hold or retain the power cables 120 clear of the feathers of an arrow being shot from the crossbow 100. In various embodiments, the power cable holding element 130 holds the power cables 120 down or towards the handle 126 such that the feathers of an arrow do not contact the power cables 120 when the arrow is being shot from the crossbow. FIG. 11 further shows two dampening elements 2256 that are disposed between the first riser plate and the second riser plate.

Figure 12:
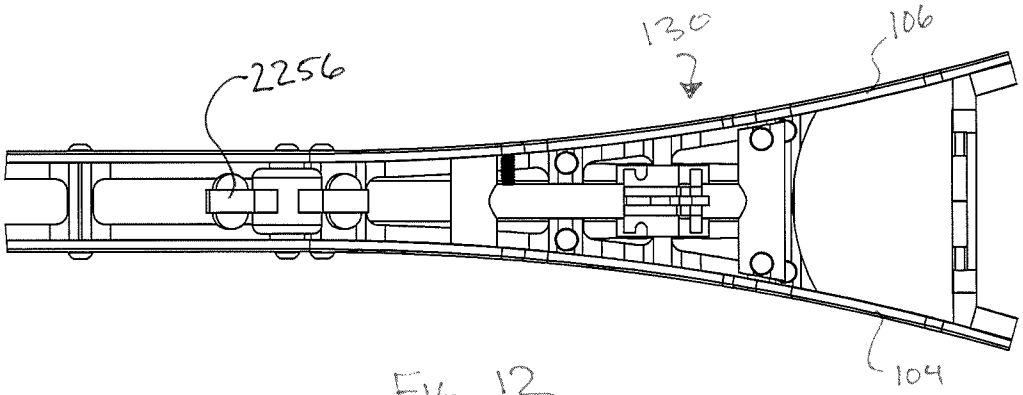
FIG. 12 is a top view of a portion of a crossbow, according to an embodiment.

FIG. 12 shows an additional view of the power cable holding element 130, according to an embodiment. In various embodiments, the power cable holding element 130 can be located within the gap 950 when the stock plates 104, 106 are parallel. In other embodiments, the power cable holding element 130 can be located in a portion of the gap where the stock plates 104, 106 are diverging from each other. In some embodiments, the power cable holding element 130 can be located in a portion of the gap where the stock plates 104, 106 start to diverge from each other.

Figure 13:
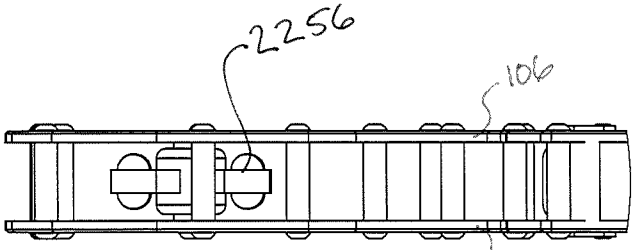
FIG. 13 is a top view of a portion of a crossbow, according to an embodiment.

FIG. 13 shows a back end view of the stock 102. The portion of the stock 102 shown in FIG. 13 can be configured to rest on against a user's shoulder while aiming or shooting the crossbow. In an embodiment, a dampening element 2256 can be disposed between the first stock plate 104 and the second stock plate 106.

Figure 14:
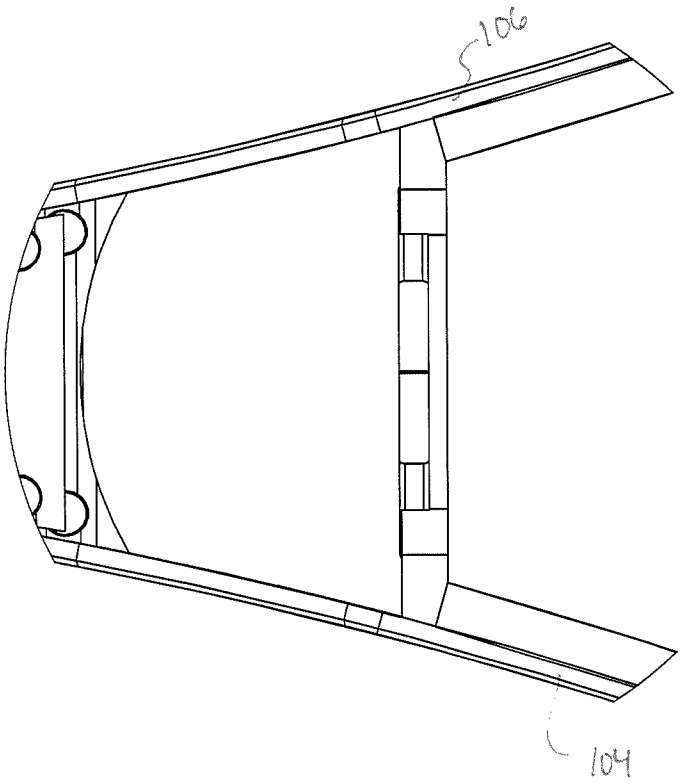
FIG. 14 is a top view of a portion of a crossbow, according to an embodiment.

FIG. 14 shows a top view of a portion of the stock 102 where the stock plates 104, 106 are diverging from each other.

Figure 15:
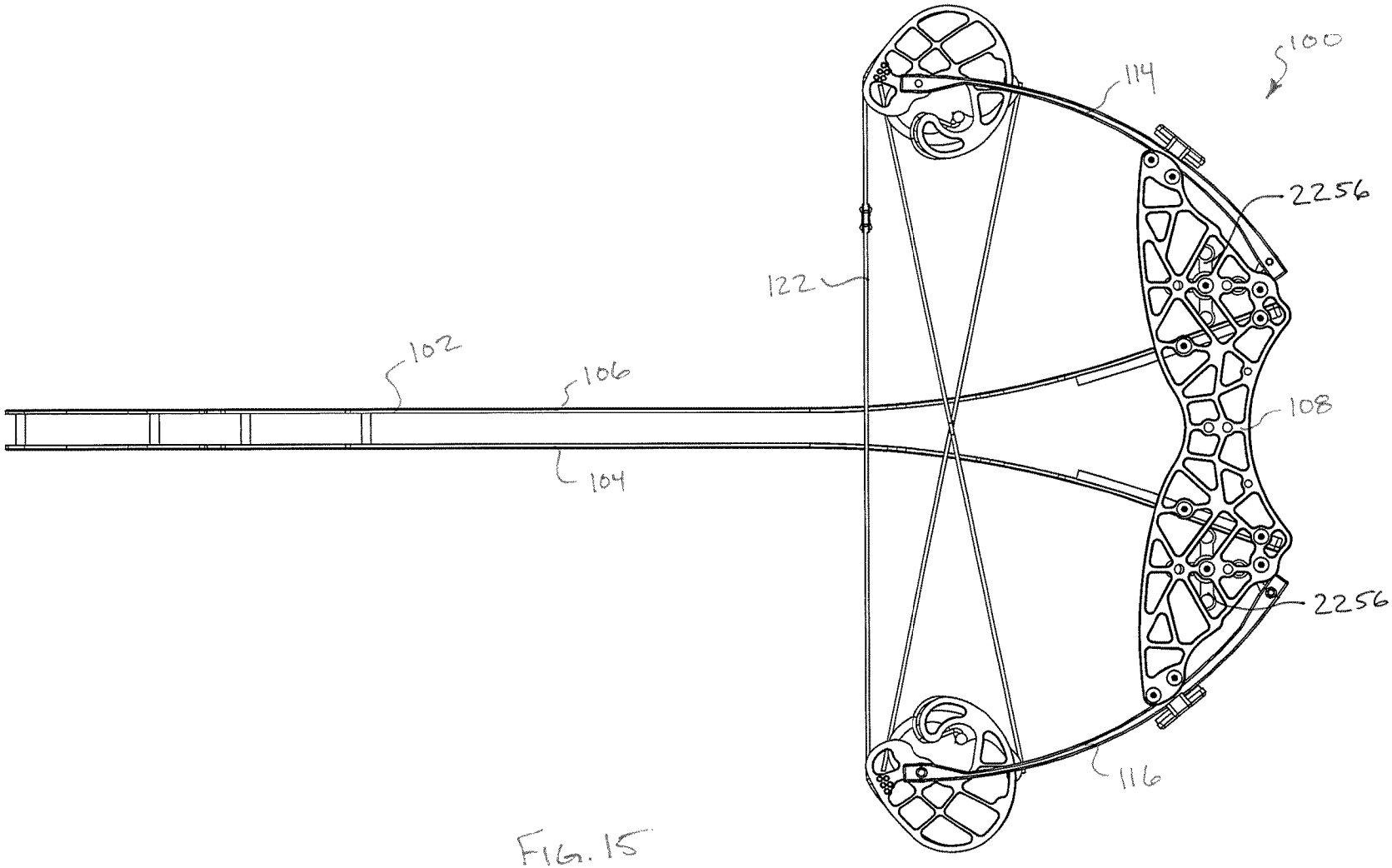
FIG. 15 is a top view of a crossbow, according to an embodiment.

FIG. 15 shows a top view of a crossbow 100, according to an embodiment. The crossbow 100 is shown with the stock 102 coupled to a compound bow which includes a riser assembly 108, a first limb 114 and a second limb 116. Other components are not shown in FIG. 15 for clarity. For example, the arrow rest 132 and arrow retention element 134 are not shown in FIG. 15. In an embodiment, the first and second stock plates 104, 106 are parallel along the portion of the stock 102 that is rearward of the drawstring 122 in a non-drawn position. The stock plates 104, 106 can diverge starting at the drawstring in the non-drawn position.

Figure 16:
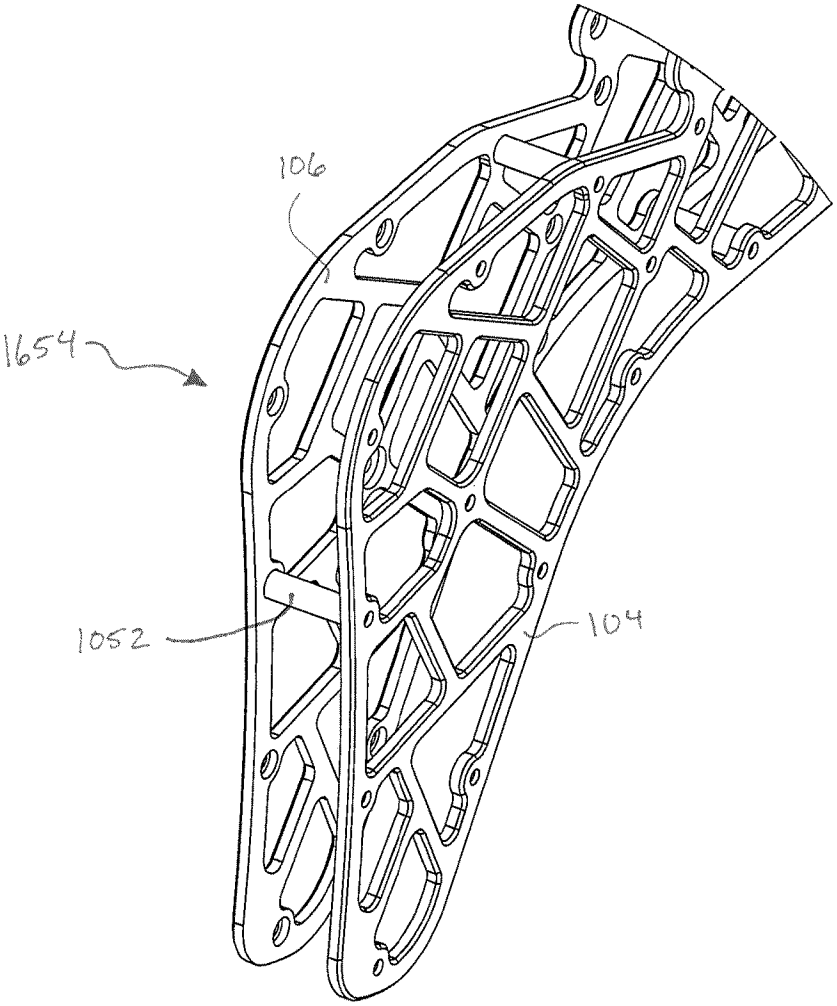
FIG. 16 is a perspective view of the shoulder end of a crossbow, according to an embodiment.
Figure 17:
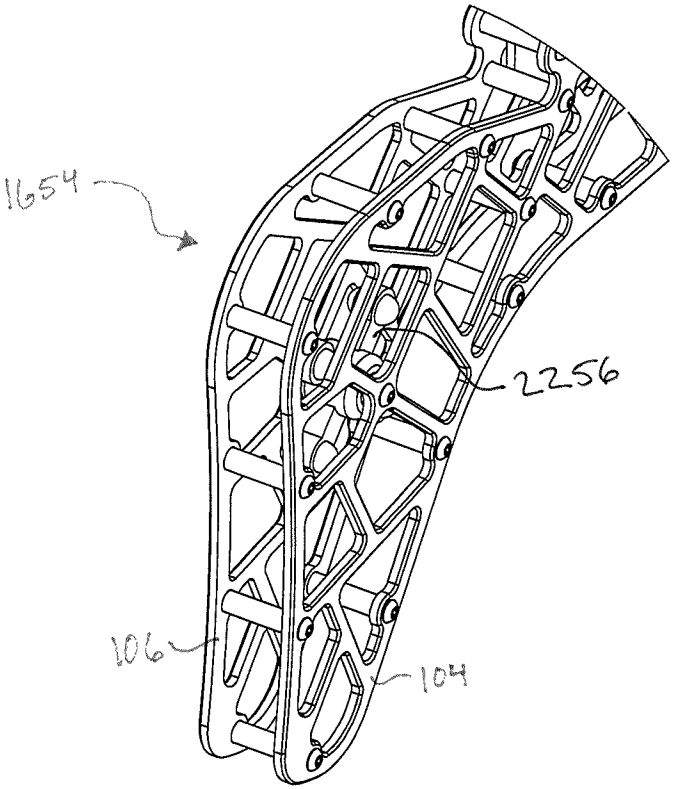
FIG. 17 is a perspective view of the shoulder end of a crossbow, according to an embodiment.

FIGS. 16 and 17 show perspective views of the shoulder end 1654 of a crossbow, according to an embodiment. In various embodiments, the end of the stock 102 opposite from the diverging stock plates 104, 106 can be configured to rest against a user's shoulder while aiming and shooting the crossbow 100. The shoulder end 1654 can include the first and second stock plates 104, 106 and connectors 1052 between the stock plates 104, 106.

Figure 18:
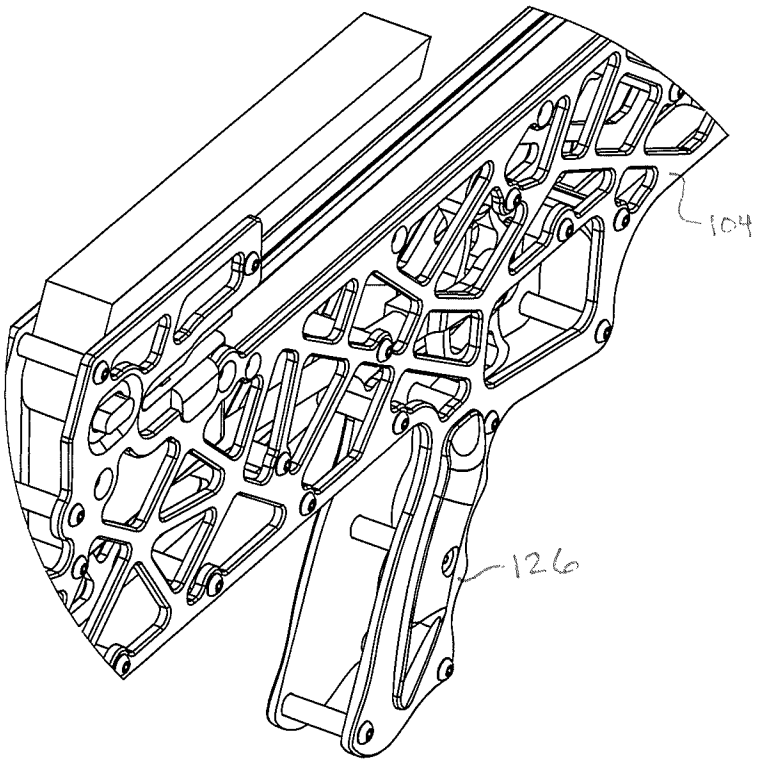
FIG. 18 is a perspective view of a portion of a crossbow, according to an embodiment.

FIG. 18 shows a perspective view of a portion of the stock 102 that includes the handle 126, according to an embodiment. In various embodiments, the first stock plate 104 and the second stock plate 106 can include extensions that define the handle 126, such as shown in FIG. 18.

Figure 20:
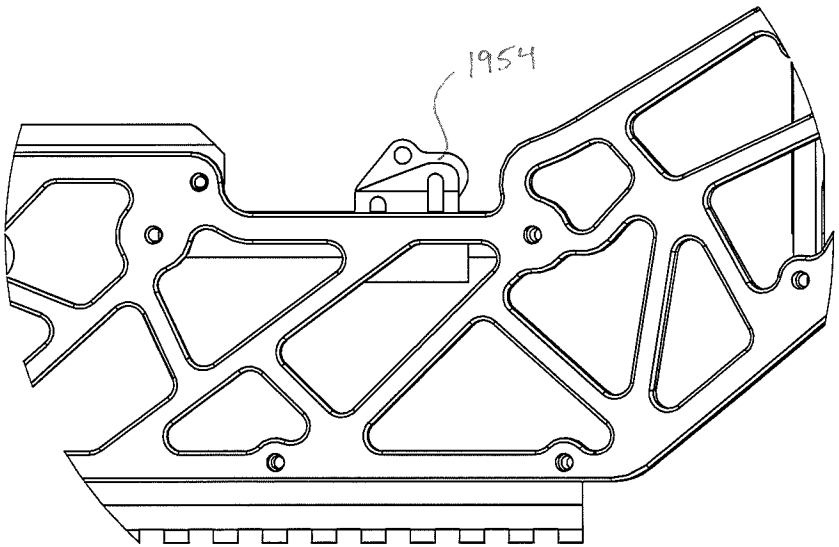
FIG. 20 is a side view of a power cable holding element of a crossbow, according to an embodiment.
Figure 19:
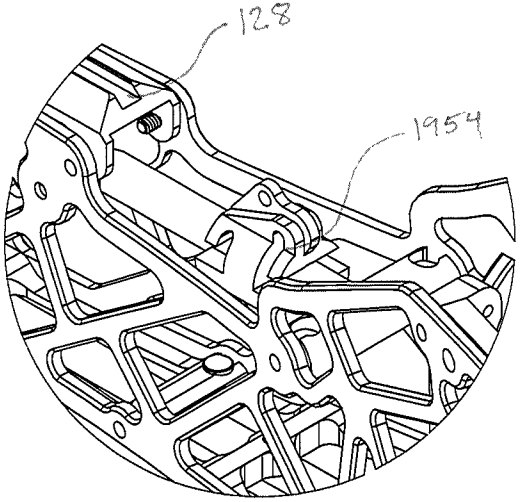
FIG. 19 is a perspective view of a power cable holding element of a crossbow, according to an embodiment.

FIG. 19 shows a perspective view of a power cable holding element 130 and FIG. 20 shows a side view of the power cable holding element 130, according to an embodiment. The power cable holding element 130 can include a finger or latch 1954 that extends over a portion of the power cable(s) 120 to retain the power cable(s) 120 clear of the path of feathers of an arrow being shot from the crossbow 100. As shown in FIG. 19, the power cable holding element 130 can hold the power cable(s) 120 below the arrow channel 128 and below the feathers which extend below the arrow channel 128.

Figure 21:
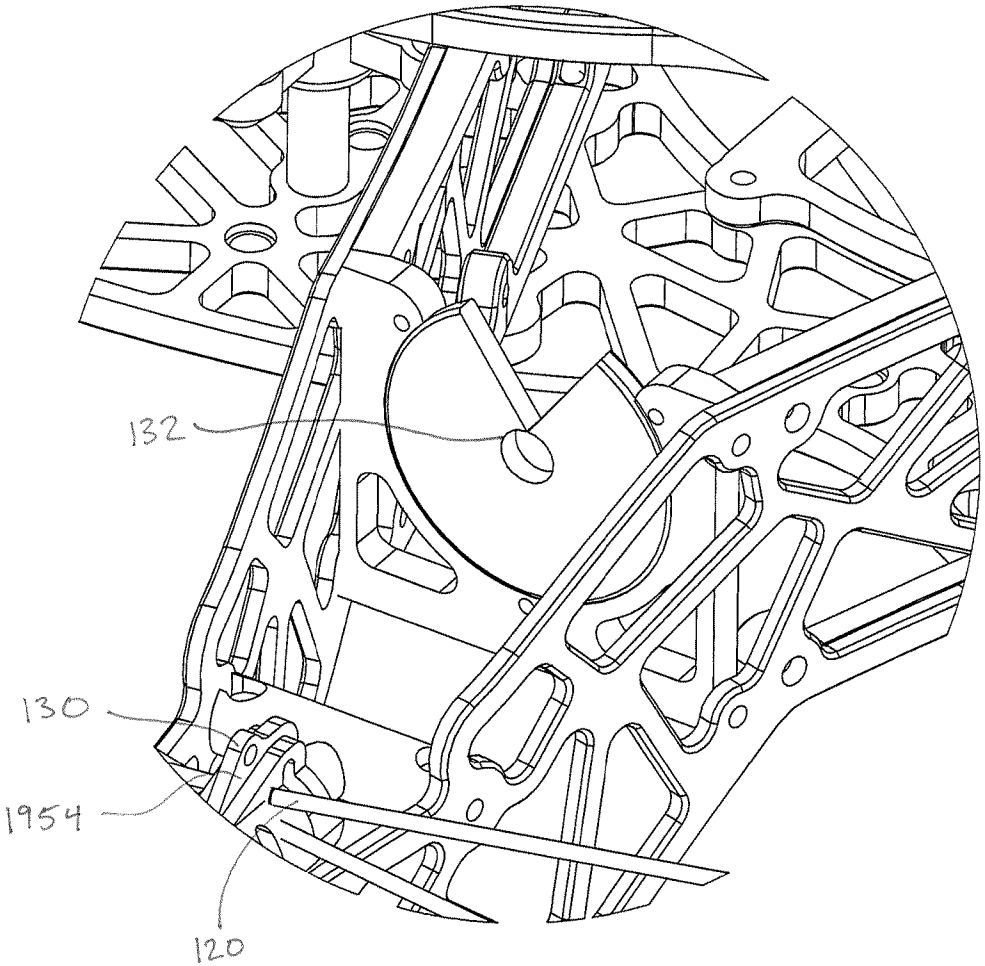
FIG. 21 is a perspective view of an arrow rest of a crossbow, according to an embodiment.

FIG. 21 shows a perspective view of a portion of a crossbow, according to an embodiment. FIG. 21 shows the power cable holding element 130 holding two power cables 120 with the latch 1954, such that the power cables 120 are held below the path of the feathers of an arrow being shot from the crossbow. FIG. 21 further shows an arrow rest 132. In an embodiment, the arrow rest 132 can include a bristles defining a hole in the center, so that the bristles encircle and hold the arrow shaft. In an embodiment, the arrow rest 132 can encircle the majority of a portion of an arrow, such as to restrict the movement of the arrow while the cross bow is being aimed or handled prior to shooting the arrow.

Figure 22A:
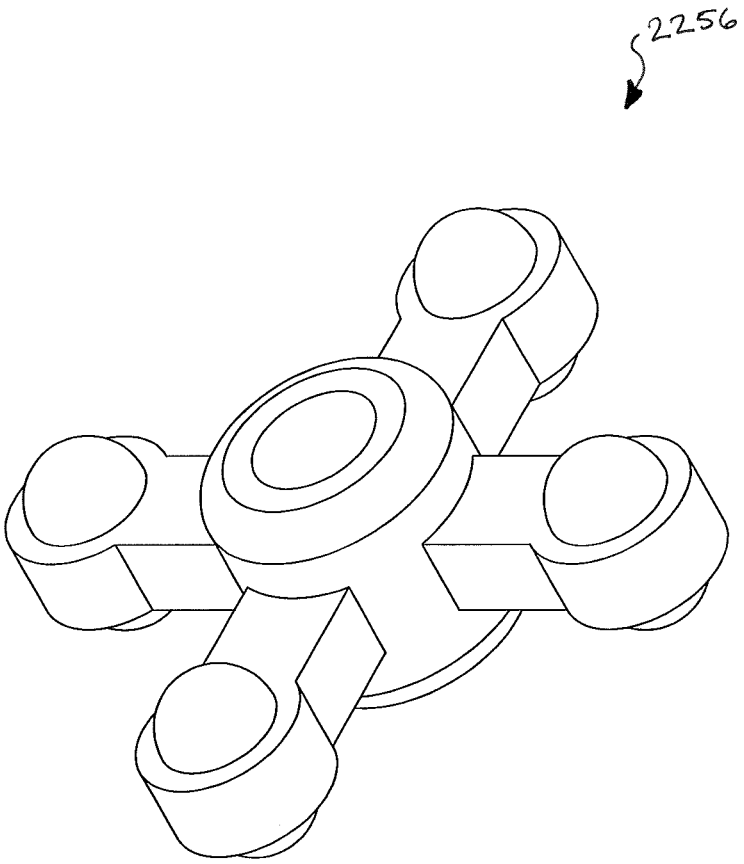
FIG. 22A is a perspective view of a dampening element, according to an embodiment.

FIG. 22A shows a perspective view of a dampening element 2256, according to an embodiment. Dampening element 2256 can be located between the two stock plates 104, 106, such as to reduce the amount of noise created by the crossbow 100 during use. In other embodiments, a dampening element can be disposed between two riser plates or within an opening defined by a stock plate or a riser plate. In some embodiments, the dampening elements 2256 can include a central hub and one or more spokes extending from the central hub. In some embodiments, the spokes can be equally spaced around a central axis of the central hub.

Figure 23:
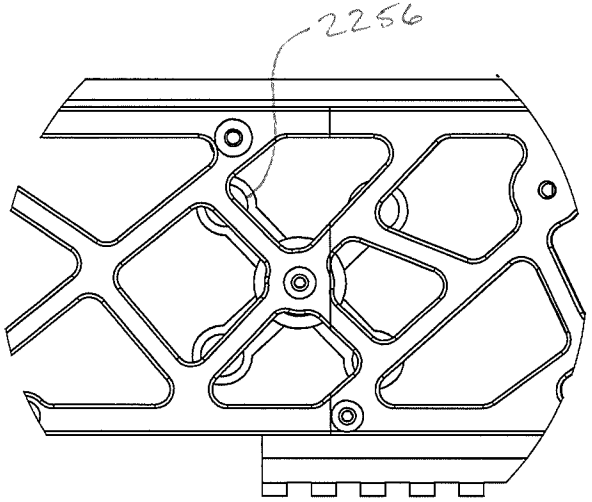
FIG. 23 is a side view of a portion of a crossbow stock, according to an embodiment.
Figure 22B:
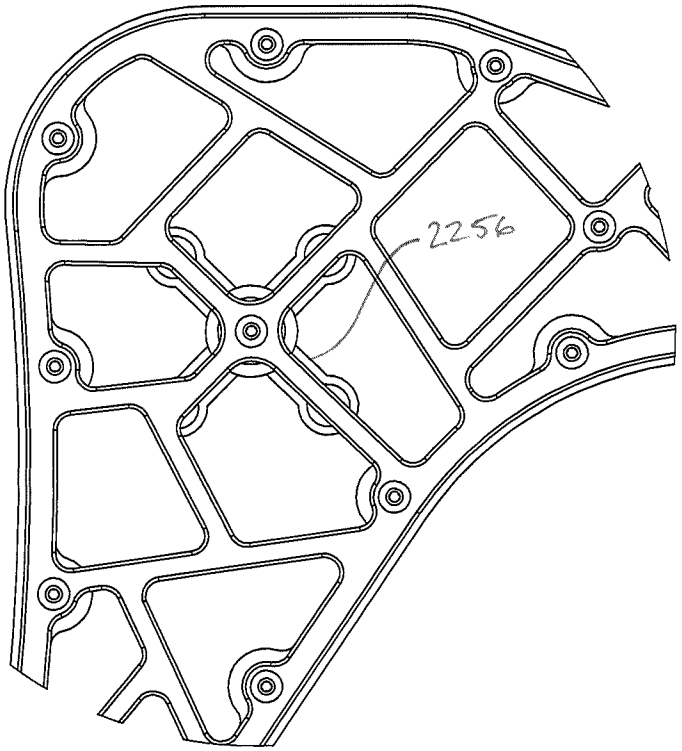
FIG. 22B is a side view of a portion of the shoulder end of a crossbow, according to an embodiment.

FIGS. 22B and 23 show side views of portions a crossbow, according to an embodiment. The first and second stock plates 104, 106 can be separated by one or more dampening elements 2256. The dampening elements 2256 can include rubber or polymer. The dampening elements 2256 can include a softer material than the material in the stock plates 104, 106. The softer material in the dampening elements 2256 can have a lower durometer than the material in the stock plates 104, 106, such that it can vibrate at a lower frequency. The dampening elements 2256 can dampen sounds made by the crossbow 100 during use. The dampening elements 2256 can absorb energy to reduce the amount of noise created between the first and second stock plates 104, 106 or first and second riser plates 110, 112 when the crossbow is in use. In some embodiments, one or more dampening elements 2256 can be disposed in one or more openings defined by the first or second stock plates 104, 106 or first or second riser plates 110, 112.

Figure 25:
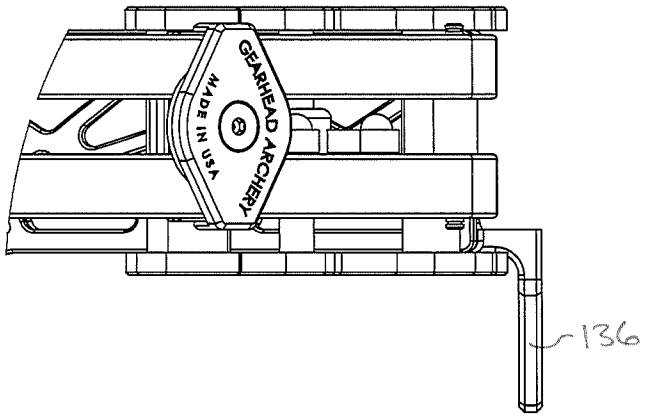
FIG. 25 is a side view of foot stirrup of a crossbow, according to an embodiment.
Figure 24:
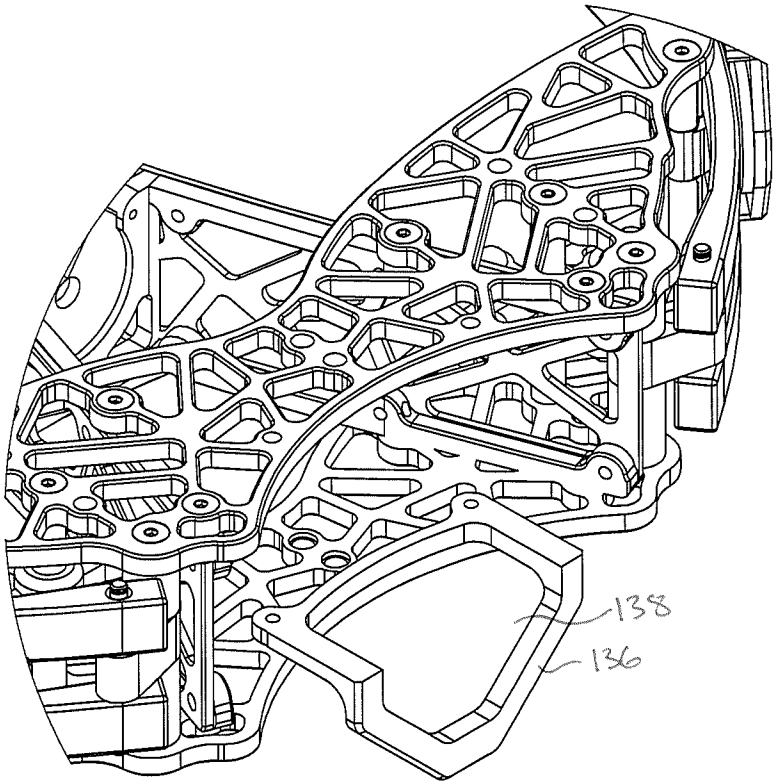
FIG. 24 is a perspective view of foot stirrup of a crossbow, according to an embodiment.

FIG. 24 shows a perspective view of foot stirrup 136, according to an embodiment. FIG. 25 shows a side view of foot stirrup 136. As discussed above, the foot stirrup 136 can define an aperture 138. The aperture 138 can be configured for a user to insert a portion of his/her foot into when drawing the drawstring 122 into a drawn position.

Figure 26:
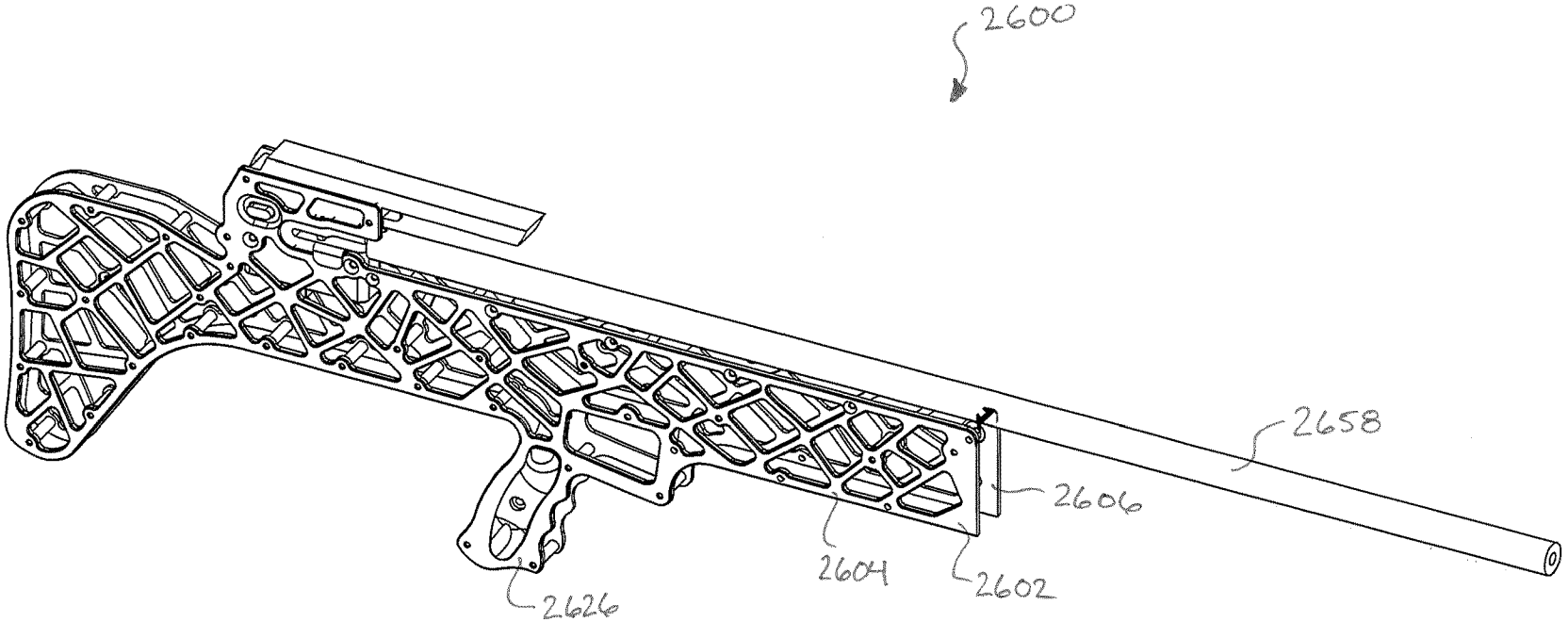
FIG. 26 is a perspective view of a rifle, according to an embodiment.
Figure 27:
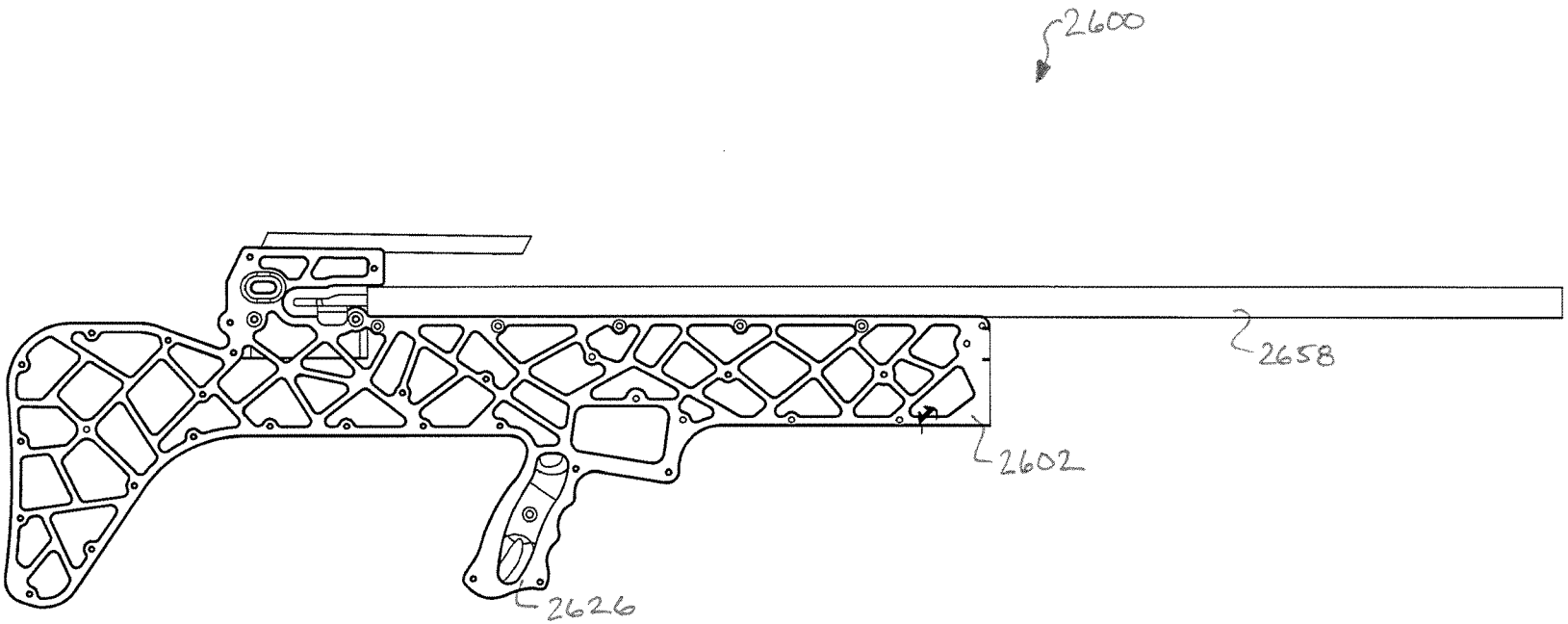
FIG. 27 is a side view of a rifle, according to an embodiment.
Figure 28:
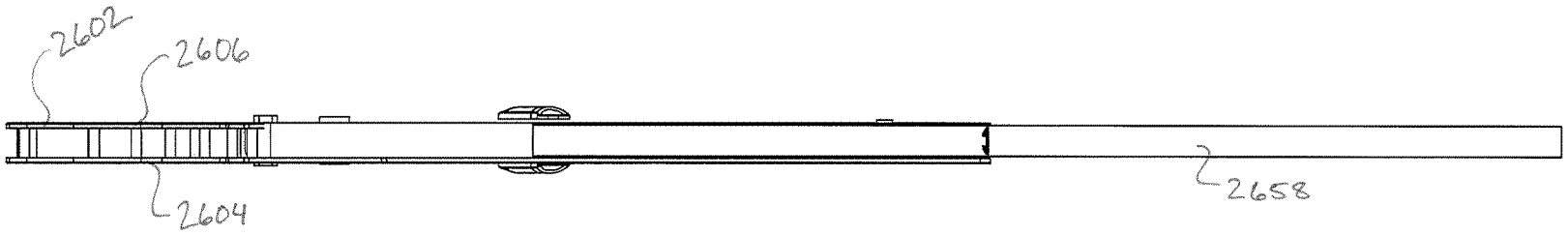
FIG. 28 is a top view of a rifle, according to an embodiment.

FIGS. 26-28 show various views of a rifle 2600, according to an embodiment. In an embodiment, a rifle 2600 can include a stock 2602. The stock 2602 can include a first stock plate 2604 and a second stock plate 2606. The rifle 2600 can include a handle 2626. The rifle 2600 can further include a barrel 2658. In various embodiments, the stock

2602 can include a rifle barrel mounting element. The rifle barrel mounting element can include one or more holes defined by the stock 2602 which can facilitate the coupling of a rifle barrel to the stock 2602, such as by allowing a connector or bolt to pass through a portion of the stock 2602. In other embodiments, the rifle barrel mounting portion can include a bracket or a surface to facilitate the coupling a rifle barrel to the stock 2602.

In various embodiments, the first stock plate 2604 and the second stock plate 2606 are parallel for at least 50% of the length of the stock 2602. In various embodiments, the first stock plate 2604 and the second stock plate 2606 are parallel for at least 75% of the length of the stock 2602. In various embodiments, the first stock plate 2604 and the second stock plate 2606 are parallel for at least 90% of the length of the stock 2602. In various embodiments, the first stock plate 2604 and the second stock plate 2606 are parallel for substantially the entire length of the stock 2602.

The first stock plate 2604 and second stock plate 2606 can include the same features as the stock plates described above. The first stock plate 2604 and second stock plate 2606 can define a gap as described elsewhere herein.

Figure 29:
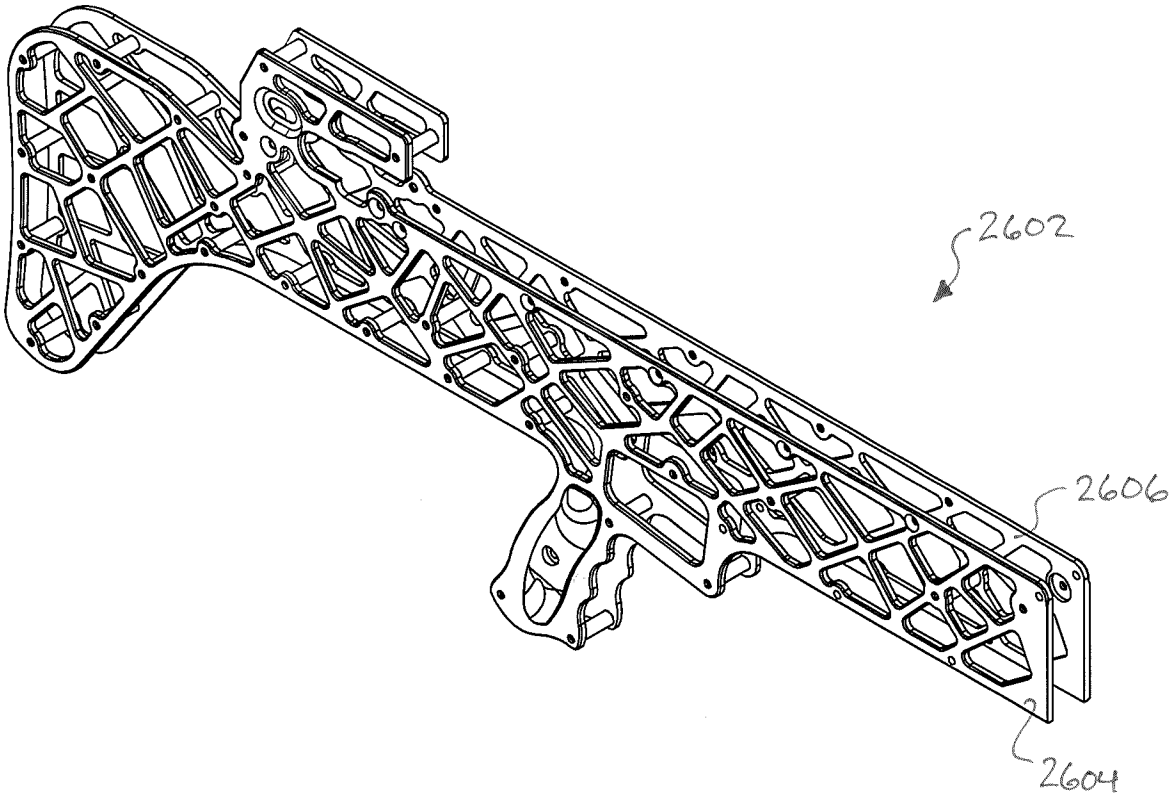
FIG. 29 is a perspective view of a rifle stock, according to an embodiment.

FIG. 29 shows a perspective view of the rifle stock 2602, according to an embodiment. As shown in FIG. 29 the first and second stock plates 2604, 2606 can be parallel for the entire length of the stock 2602.

It should be noted that, as used in this specification and the appended claims, the singular forms "a," "an," and "the" include plural referents unless the content clearly dictates otherwise. Thus, for example, reference to a composition containing "a compound" includes a mixture of two or more compounds. It should also be noted that the term "or" is generally employed in its sense including "and/or" unless the content clearly dictates otherwise.

It should also be noted that, as used in this specification and the appended claims, the phrase "configured" describes a system, apparatus, or other structure that is constructed or configured to perform a particular task or adopt a particular configuration to. The phrase "configured" can be used interchangeably with other similar phrases such as arranged and configured, constructed and arranged, constructed, manufactured and arranged, and the like.

All publications and patent applications in this specification are indicative of the level of ordinary skill in the art to which this invention pertains. All publications and patent applications are herein incorporated by reference to the same extent as if each individual publication or patent application was specifically and individually indicated by reference.

Aspects have been described with reference to various specific and preferred embodiments and techniques. However, it should be understood that many variations and modifications may be made while remaining within the spirit and scope herein.

The claims are:

1. A crossbow, comprising:

a stock, the stock comprising a first stock plate and a second stock plate, wherein the first stock plate and the second stock plate define a gap; and a bow portion comprising:

a riser assembly, a first limb coupled to the riser assembly, a second limb coupled to the riser assembly; and a drawstring extending from a distal end of the first limb to a distal end of the second limb;

wherein the bow portion is coupled to the stock;

wherein a width of the gap is at least ½ inch and not more than 2 inches;

wherein the first stock plate and the second stock plate are each no more than ¼ inch thick;

wherein the first stock plate and the second stock plate diverge from each other along a portion of the length of the stock to increase the size of the gap.

2. The crossbow of claim 1, wherein the first stock plate and the second stock plate are parallel along at least 50% of a length of the stock.

3. The crossbow of claim 2, wherein the first stock plate and the second stock plate are planar along the at least 50% of the length of the stock where the first stock plate and the second stock plate are parallel.

4. The crossbow of claim 1, wherein the stock comprises an arrow channel element, wherein the arrow channel element defines an arrow channel; wherein the arrow channel element is configured to receive an arrow with a cock feather orientated vertically away from a bottom portion of the stock, wherein a handle portion extends from the bottom portion of the stock.

5. The crossbow of claim 4, wherein the arrow channel element comprises a first surface configured to support a first hen feather of the arrow and a second surface configured to support a second hen feather of the arrow.

6. The crossbow of claim 1, further comprising a dampening element disposed within the gap or within an opening defined by the first stock plate or the second stock plate.

7. The crossbow of claim 1, wherein the gap extends through the ends of the stock, such that the first stock plate and the second stock plate are separated at the ends.

8. A stock for a crossbow or rifle, comprising:

a first stock plate and a second stock plate, wherein the first stock plate and the second stock plate define a gap, wherein a width of the gap varies along the length of the stock;

a bow or rifle mounting element coupled to or defined by the first stock plate or the second stock plate.

9. The stock for a cross bow or rife of claim 8, wherein a width of the gap is at least ½ inch and not more than 2 inches along at least 50% of the length of the stock.

10. The stock for a cross bow or rife of claim 8, wherein the width of the gap is the largest at an end of the stock.

11. A crossbow, comprising:

a stock, the stock comprising a first stock plate and a second stock plate, wherein the first stock plate and the second stock plate define a gap, the stock further comprising an arrow channel element, wherein the arrow channel element defines an arrow channel, wherein the arrow channel element is configured to receive an arrow with a cock feather orientated vertically away from a bottom portion of the stock, wherein a handle portion extends from the bottom portion of the stock; and a bow portion comprising:

a riser assembly, a first limb coupled to the riser assembly, a second limb coupled to the riser assembly; and a drawstring extending from a distal end of the first limb to a distal end of the second limb;

wherein the bow portion is coupled to the stock;

wherein a width of the gap is at least ½ inch and not more than 2 inches;

wherein the first stock plate and the second stock plate are each no more than ¼ inch thick.

12. The crossbow of claim 11, wherein the first stock plate and the second stock plate are planar along at least 50% of the length of the stock.

13. The crossbow of claim 11, wherein the first stock plate and the second stock plate each comprise carbon fiber, aluminum, titanium, a polymer, or wood.

14. The crossbow of claim 11, wherein a width of the gap is at least ½ inch and not more than 2 inches along at least 50% of the length of the stock.

15. The crossbow of claim 11, wherein the first stock plate and the second stock plate are each a single continuous component.

16. The crossbow of claim 11, wherein the gap extends through the ends of the stock, such that the first stock plate and the second stock plate are separated at the ends.

17. The crossbow of claim 11, further comprising a dampening element disposed within the gap or within an opening defined by the first stock plate or the second stock plate.

* * * * *